US009355537B2

(12) United States Patent
Maddox et al.

(10) Patent No.: US 9,355,537 B2
(45) Date of Patent: May 31, 2016

(54) OPTICAL SECURITY TAG

(71) Applicant: DUBOIS LIMITED, Corby, Northamptonshire (GB)

(72) Inventors: Sean D. Maddox, Fransfield (GB); Peter A. Farrar, Menston (GB); Mark R. Marriott, Theddingworth (GB)

(73) Assignee: DUBOIS LIMITED, Corby (GB)

( * ) Notice: Subject to any disclaimer, the term of this patent is extended or adjusted under 35 U.S.C. 154(b) by 21 days.

(21) Appl. No.: 14/465,225

(22) Filed: Aug. 21, 2014

(65) Prior Publication Data

US 2016/0055729 A1 Feb. 25, 2016

(51) Int. Cl.
*G08B 13/14* (2006.01)
*G08B 13/189* (2006.01)

(52) U.S. Cl.
CPC ..... *G08B 13/1895* (2013.01)

(58) Field of Classification Search
CPC ... G06K 1/00; G08B 13/1481; G08B 13/1895
USPC ..... 340/572.1, 572.2–572.9, 13.26, 815.5, 340/545.5
See application file for complete search history.

(56) References Cited

U.S. PATENT DOCUMENTS

| | | | | |
|---|---|---|---|---|
| 5,936,523 | A * | 8/1999 | West | 340/545.6 |
| 7,315,253 | B1 | 1/2008 | Pijanowski et al. | |
| 7,404,484 | B2 | 7/2008 | Farrar et al. | |
| 8,354,927 | B2 | 1/2013 | Breed | |
| 8,362,496 | B1 | 1/2013 | Tu et al. | |
| 8,552,866 | B2 * | 10/2013 | Pokrajac et al. | 340/572.1 |
| 2009/0309722 | A1 * | 12/2009 | Nichols et al. | 340/541 |
| 2011/0210030 | A1 | 9/2011 | Londo et al. | |
| 2012/0132788 | A1 | 5/2012 | Findlay | |
| 2012/0153153 | A1 | 6/2012 | Chang et al. | |
| 2014/0191870 | A1 * | 7/2014 | Valiulis | 340/572.1 |

FOREIGN PATENT DOCUMENTS

| | | | |
|---|---|---|---|
| WO | 9702569 | A1 | 1/1997 |
| WO | 2004037660 | A1 | 5/2004 |
| WO | 2004/064523 | A1 | 6/2006 |
| WO | 2010/080770 | A1 | 7/2010 |
| WO | 2011/047961 | A1 | 4/2011 |
| WO | 2012/099708 | A1 | 7/2012 |

* cited by examiner

*Primary Examiner* — Phung Nguyen
(74) *Attorney, Agent, or Firm* — Pillsbury Winthrop Shaw Pittman LLP

(57) ABSTRACT

A security tag or device for use with a product package. The security tag has an optical sensor that detects ambient radiation (or light, if any) within the package interior (e.g., from a source outside the package). The optical sensor is temporarily limited from detecting the ambient radiation within the package by a lock section. A device may be provided to activate the lock section so that the optical sensor can detect light in the package. The optical sensor can be aligned with an opening in the package after the lock section is activated. After calibration, the optical sensor is used to determine changes in detected ambient radiation within the package. The security tag has an alarm adapted to provide an alert when a change (e.g., above a threshold) in intensity of ambient radiation within a package is detected by the optical sensor.

26 Claims, 10 Drawing Sheets

OPTICAL SECURITY TAG

BACKGROUND

1. Technical Field

This present invention relates generally to devices for holding and enclosing products and to security devices or tags for use with such devices to substantially prevent or deter theft. More particularly, it relates to a container or package for a product having a security device or tag with an optical sensor.

2. Description of Related Art

Many types of containers are known for consumer products, including cosmetics, such as perfumes and makeup, electronic devices, such as cellular phones, MP3 players, cameras, navigation systems, as well as other types of products that are housed in different types of packaging.

A problem encountered with such known apparatuses is the removal and theft of a product for sale from the apparatus within a store selling such products. The product is usually provided within a container which is provided with a security tag which triggers an alarm if the container is taken out of the store without the tag first being removed or rendered inactive by staff in the store. However, it has been found that thieves may be able to remove a product from the packaging, thereby thwarting the use of a security tag. They then leave the empty container on the shelf and leave the store with the product outside of the packaging without triggering the alarm system.

There are also other ways thieves can try to avoid the existing security measures taken by stores selling products. Security tags are often provided on the external surface of the products or their packaging, and thieves may, for instance, remove or disable these. Known devices can simply be peeled off or deactivated by use of magnets or other methods. Generally, known tags do not include their own alarm as a whole, or provide monitoring function(s) to determine if a package has been opened and/or the product removed (from the package) and to self-alarm if a product is removed from the package. Current and known tags are typically deactivated at checkout, which is not very secure with regards to the product or contents in the package.

Cardboard is an example of a cheaper packaging material that is not capital intensive and decorates well and easily. However, because cardboard is a weaker material (e.g., as compared to molded plastic), containers made of cardboard can more easily be broken into, resulting its product being removed, or security tag(s) being peeled off For reasons like these, many stores only display empty containers and when a customer has made a selection, the staff retrieves the relevant product from a secure cupboard or safe and places it in the container for the customer. Often devices called safers or keepers, e.g., polycarbonate clear boxes for holding and storing products, are provided with a lock for use in stores. However, this takes additional time and requires an additional secure storage place for the products. It also increases the risk that the wrong product may be put in the container, especially if the staff is busy. The stores would also prefer for the products to be held within the boxes on display as this is more appealing to a potential customer than an empty box (and has been shown to significantly increase sales). There is therefore a desire within the trade to be able to display product containers with the relevant product already held therein; such a practice being known as "live" storage within the trade.

Other options include a spider wrap, or a system of wires, that is provided around containers or the package, with a central hub that carries the alarm and EAS. Such a system tends to be unstable and fiddly, and the wires can be slipped off of the product by thieves. It also covers any artwork of the container or package, making product details more difficult to read, less atheistically pleasing, and making it a more clumsy sell. Packaging is meant to promote and help sell the product.

Prior art devices for increasing the security of such containers, such as safers, "keepers", or "spider" type security devices, tend to be bulky and expensive, difficult to handle, unaesthetically pleasing, and/or limited to application of specific types of packages (e.g., media containers). WO Publication No. 97/02569, U.S. Pat. No. 7,404,484, and U.S. Pat. No. 7,315,253, each of which is incorporated by reference in its entirety herein, show examples of such types of known devices.

However, existing containers and security devices do not adequately alert a retailer when a container is being tampered with in order to steal a product inside of the container in order to thwart the security system of the retail environment. Therefore, a need exists for a product container having an improved security device.

SUMMARY

An objective is to have a simple security tag that can be placed on a box, container, or package and activate an alarm, when the package is opened or removed from the store, e.g., via an EAS function.

One aspect of the disclosure provides a security tag. The security tag may be used in or with a package. The security tag includes: a housing with a battery therein; an optical sensor configured to detect ambient radiation within the package and a circuit configured to connect the battery and the optical sensor. An alarm or indicator is further connected to the circuit and adapted to provide an alert. Also included is an attachment portion for attaching the housing to the package that has a lock section that limits the optical sensor from detecting the ambient radiation within the package. A device for activating the lock section is provided. The optical sensor is configured to detect changes of intensity of the ambient radiation within the package. The optical sensor is also configured to activate the alarm or indicator and provide the alert upon detection of a change in intensity above a threshold level.

Another aspect of this disclosure provides a security tag. The security tag includes: a housing with a battery therein and an optical sensor within the housing. The housing has a first portion and a second portion, and the first portion is configured for movement relative to the second portion. The optical sensor is configured to detect ambient radiation within the package. The second portion of the housing has a lock section that limits the optical sensor from detecting ambient radiation within the package. The first portion has a device for activating the lock section. The security tag further has a circuit configured to connect the battery and the optical sensor such that the optical sensor is activated for detection and an alarm or indicator further connected to the circuit and adapted to provide an alert. Movement of the first portion relative to the second portion is configured to correspondingly move the device for activating the lock section, thereby activating the lock section to expose the optical sensor for detecting the ambient radiation within the package and further activate the circuit connection between the battery and the optical sensor. The optical sensor is configured to detect changes of intensity of the ambient radiation within the package. The optical sensor is configured to activate the alarm or indicator and provide the alert upon detect of a change in intensity above a threshold level.

According to yet another aspect, a product package is provided. The product package includes: a plurality of walls configured to contain contents in an interior cavity; at least one of the plurality of walls of the product package configured to be moved between (a) an open position allowing access to contents inside the interior cavity of the product package via an opening and (b) a closed position substantially preventing access to the contents within the interior cavity therein by closing the opening; and a security device being removably connected to the product package. The security device includes a housing with a battery, an optical sensor positioned and configured to detect ambient radiation in the interior cavity of the product package, a circuit configured to connect the battery and the optical sensor for detection, an alarm or indicator connected to the circuit and adapted to provide an alert, an attachment portion for attaching the housing to the package, and a device. The attachment portion has a lock section that limits the optical sensor from detecting ambient radiation within the package. The device is provided for activating the lock section. The optical sensor is configured to detect changes of intensity of the ambient radiation within the package. The optical sensor is also configured to activate the alarm or indicator and provide the alert upon detection of a change in intensity above a threshold level.

In still yet another aspect, there is provided a method for operating a security tag attached to a package. The security tag has a housing, a battery, an optical sensor configured to detect an intensity of ambient radiation within the package, a circuit configured to connect the battery and the optical sensor such that the optical sensor is activated for detection, and an alarm or indicator adapted to provide an alert. The housing includes a first portion and a second portion. The first portion is configured for movement relative to the second portion in a first direction. The second portion has a lock section that limits the optical sensor from detecting the intensity of ambient radiation within the package, and the first portion has a device for activating the lock section. The method includes activating the optical sensor by moving the first portion relative to the second portion in the first direction; detecting changes of intensity of the ambient radiation within the package; and activating the alarm or indicator and providing the alert. Movement of the first portion relative to the second portion activates the device for activating the lock section thereby activating the lock section to expose the optical sensor for detecting the ambient radiation within the package and further activate the circuit connection between the battery and the optical sensor. The optical sensor is configured to activate the alarm or indicator and provide the alert upon detection of a change in intensity above a threshold level.

Other features and advantages of the present disclosure will become apparent from the following detailed description, the accompanying drawings, and the appended claims.

DETAILED DESCRIPTION

Generally, the present disclosure is for a product package or product container for a retail product, such as a digital camera, MP3 player, cellular phone and/or other consumer electronics products, gift cards, rewards cards, exchangeable cards, reusable and/or reloadable cards, and the like. "Package" and "container" are used herein interchangeably throughout, it should be understood that both are designed to package items for sale in retail environments. Similarly, such terms should not be limiting and could also be called a case or structure. Furthermore, the terms "interior" and "exterior," "inner" and "outer," and "inside" and "outside" are used throughout the description on a reference basis, and may be interchangeable, unless additionally stated. Such terms are not meant to be limiting. Any depiction or description, including size, shape, design, etc. of the packages, sensor, arms, and security devices herein is exemplary only and not intended to be limiting in any way.

The term "security tag" is used herein to refer to any form of component which triggers an alarm if it or the package or product is tampered with. The description and Figures herein disclose a security device or "security tag" (as referred to herethroughout and used interchangeably) with an optical sensor (or optical sensing system) for detecting ambient radiation within, and any change thereof, the interior of the package. A radio signal can be sent to indicate the detected change, and/or an alarm (optional) or other indicator (optional) can be activated to provide an alert of unauthorized entry, e.g., upon detection of a [predetermined amount of] change in the ambient radiation (e.g., a change that exceeds a threshold level) inside the package by the optical sensor and a circuit and/or controller.

The illustrations include an embodiment of a product package having a plurality of walls configured to contain contents therein upon assembly (e.g., when formed from a blank). Each of the walls has an interior surface and an exterior surface. At least one of the walls is also configured to be moved between an open position allowing access to contents in the product package via an opening and a closed position substantially preventing access to the contents therein by closing the opening. The security tag can be secured or attached to such a product package, with its optical sensor aligned with an aperture or inserted through the wall(s) of the package (e.g., via a receiving opening).

Figure 1:
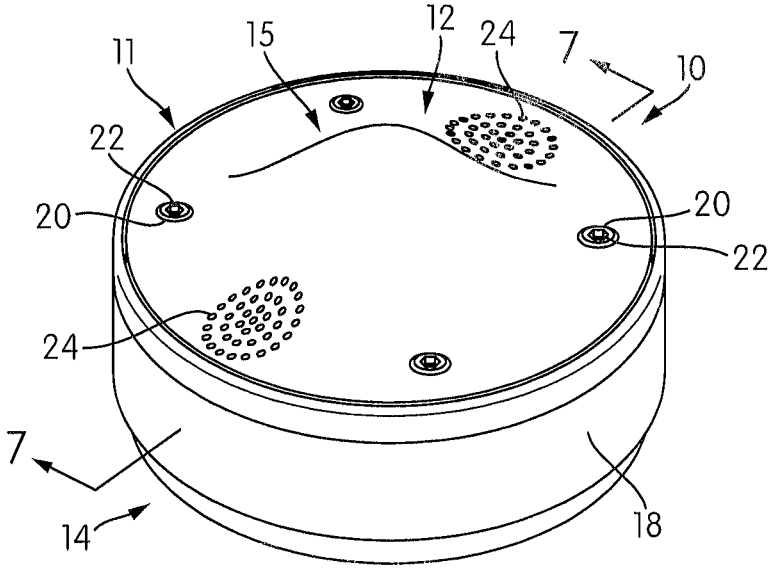
FIG. 1 illustrates a top perspective view of a security tag in accordance with an embodiment of this disclosure.
Figure 8:
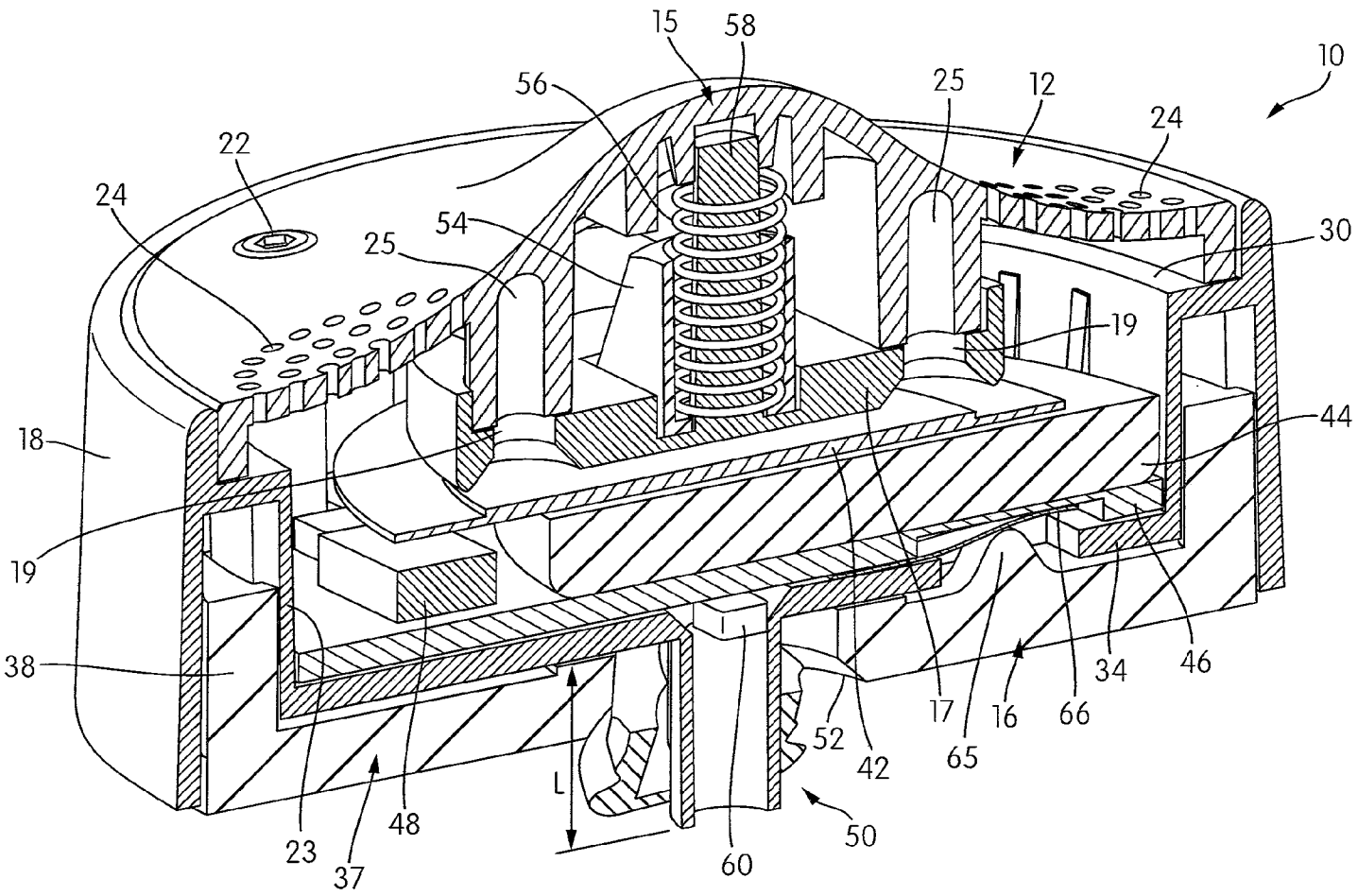
FIG. 8 is a cross sectional view of the security tag in FIG. 1 in a second position, in accordance with an embodiment.
Figure 9:
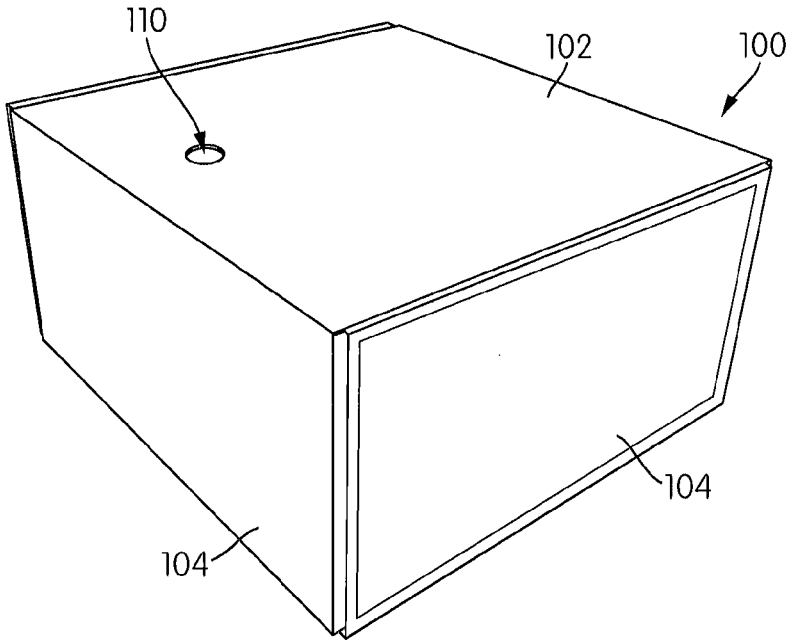
FIG. 9 illustrates a perspective view of an exemplary product package in a closed position for use with a security tag in accordance with this disclosure.
Figure 10:
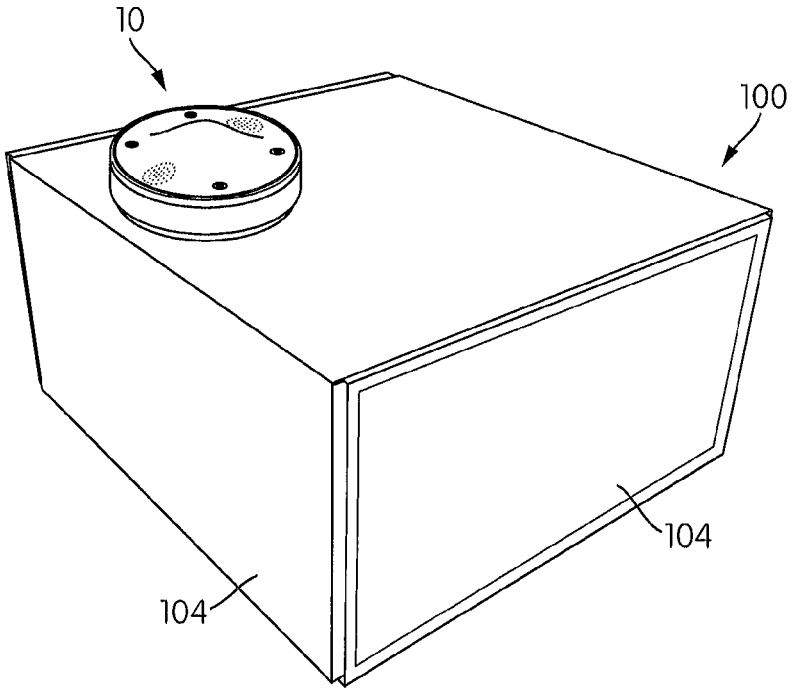
FIG. 10 illustrates a top perspective view of a security tag on the package of FIG. 9 in accordance with an embodiment of this disclosure.

FIG. 1 illustrates a top perspective view of a security tag 10 in accordance with an embodiment of this disclosure. A security tag 10 is adapted to cooperate with a product package, case, or container. The security tag 10 is removably connected to the product package, e.g., product package 1000 as shown in FIGS. 8-10. In an embodiment, the security tag 10 is adapted to be removably attached to a product package 100. In an embodiment, at least a portion of the security tag 10 is adapted to be removably inserted into or through a predetermined opening in the product package 100. For example, as shown in FIG. 10, a part of the security tag 10 can be adapted to be aligned with and removably inserted into a receiving opening 110 on a wall or a lid of the body of the product package 100, as further described later.

The security tag 10 includes a housing 11 with a body 14, a top portion 12 or lid, and a bottom portion 16. The top portion 12, body 14, and bottom portion 16 may be formed separately and attached together.

Figure 3:
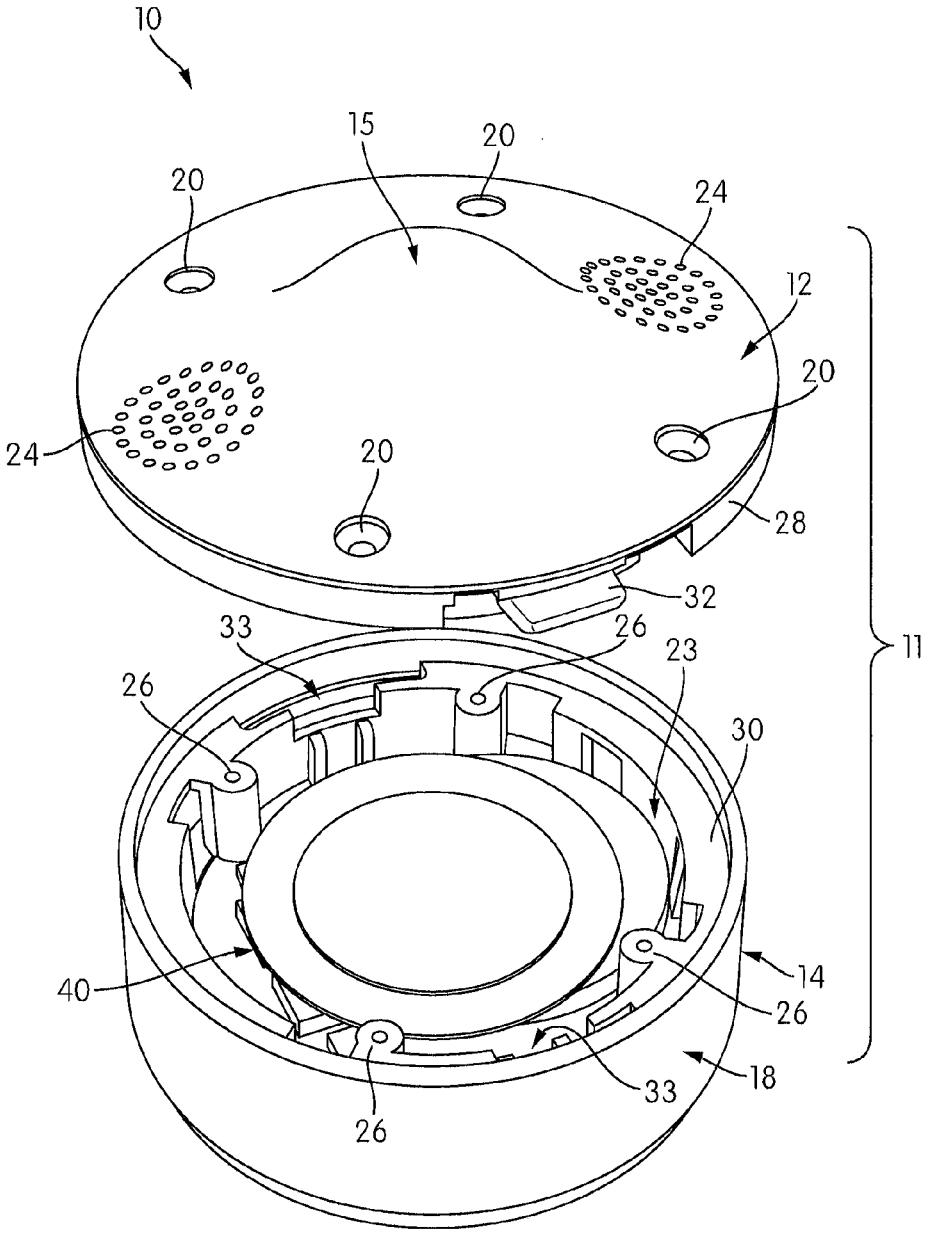
FIG. 3 illustrates a top perspective view of the security tag in FIG. 1, in accordance with an embodiment, with a top portion removed from its body.
Figure 4:
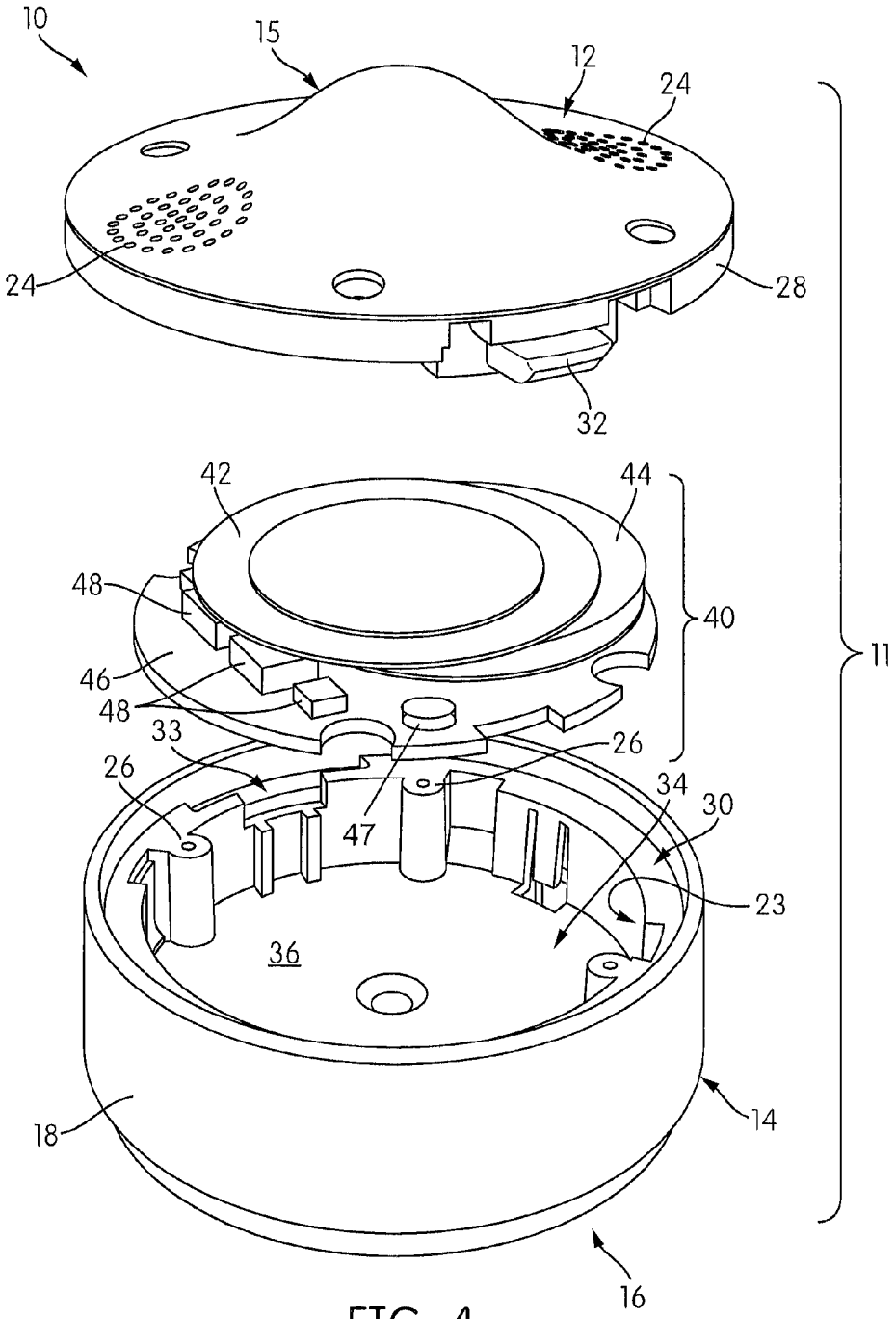
FIG. 4 illustrates a partially exploded view of the parts of the security tag in FIG. 1, in accordance with an embodiment, as viewed from a top perspective.
Figure 7:
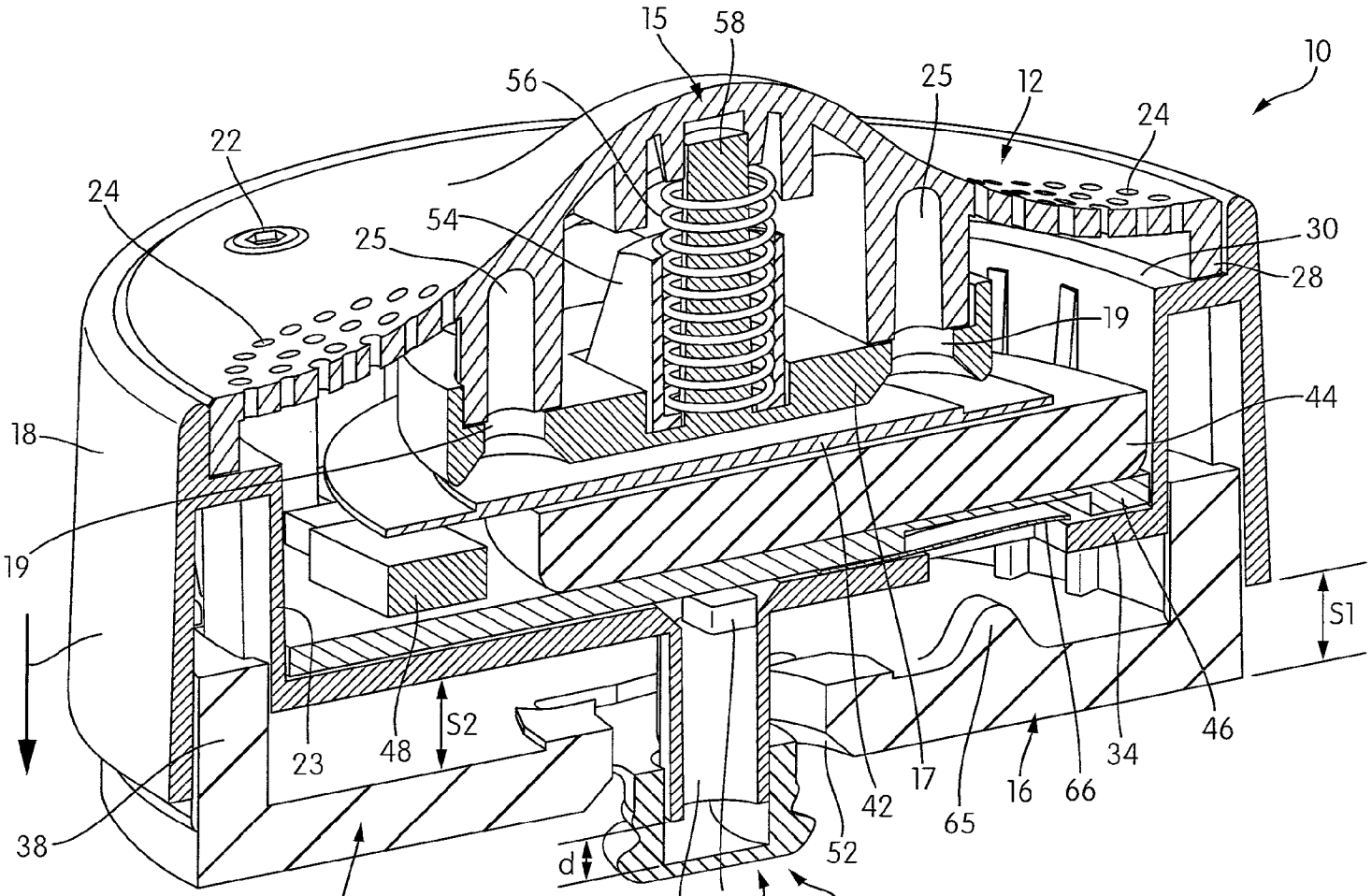
FIG. 7 is a cross sectional view taken along line 7-7 of the security tag in FIG. 1, in accordance with an embodiment, with the security tag in a first position.

As shown in FIG. 4, the body 14 includes an outer wall 18 and an internal cavity defined by an inner wall 23 and a bottom wall 34. The inner wall 23 may be spaced relative to the outer wall 18. A recessed wall area 30 can be provided inside the body 14 between the outer wall 18 and inner wall 23. The recessed wall area 30 is configured for receipt of the top portion 12. For example, as see in FIGS. 3 and 4, the top portion 12 may include a downwardly extending lip 28. The lip 28 can be inserted into and received by the body 14 and placed adjacent the recessed wall area 30, as shown in FIG. 7, for example, such that a top edge of the outer wall 18 and a top surface of the top portion 12 or lid are substantially flush.

The top portion 12 may include connection portions 20 with openings therethrough for receipt of fasteners 22 (see FIGS. 3 and 4). The openings of the connection portions 20 can align with openings 26 in or about the internal cavity of the body 14 when the lip 28 is placed within the recessed wall area 30, such that the fasteners 22 can be inserted and extend through the two aligned openings, thus connecting and securing the top portion 12 or lid to at least the body 14 (or the rest of the housing 11).

Figure 5:
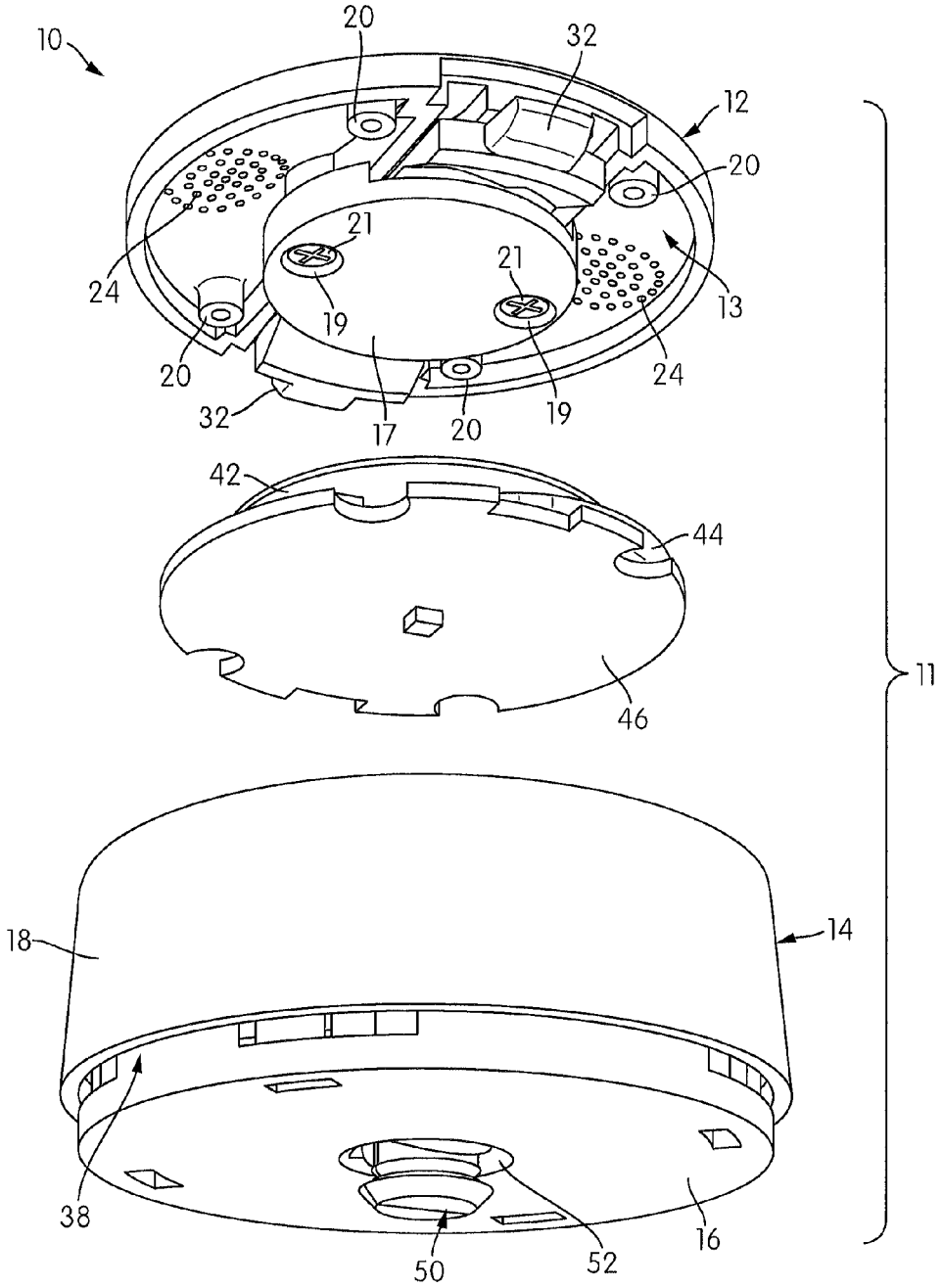
FIG. 5 illustrates a partially exploded view of the parts of the security tag in FIG. 1, in accordance with an embodiment, as viewed from a bottom perspective.

In an embodiment, as partly seen in FIG. 3, for example, the top portion 12 includes at least one tab 32 that can be aligned with at least one receiver 33 in the body 14. In accordance with an embodiment, as seen in the underside view of the top portion 12 of FIG. 5, and in the underside view of FIG. 6, two tabs 32 may be provided. Thus, two receivers 33 may be provided in the body 14. The receiver(s) 33 may be provided on or along the recessed wall area 30, as shown in FIG. 4, and within the internal cavity of the body 14. The tab(s) 32 may be aligned with the receiver(s) 33 to further assist in connecting the top portion 12 and body 14. For example, alignment of the tab(s) 32 with the receiver(s) 33 can ensure that the openings of the connection portions are aligned with the openings 26 in the body 14. In an embodiment, the tab(s) 32 are resilient. In an embodiment, the tab(s) 32 are configured for a snap-fit connection into the receiver(s) 33 in the body 14. In an embodiment, each tab(s) 32 is connected to a body portion 31.

Figure 6:
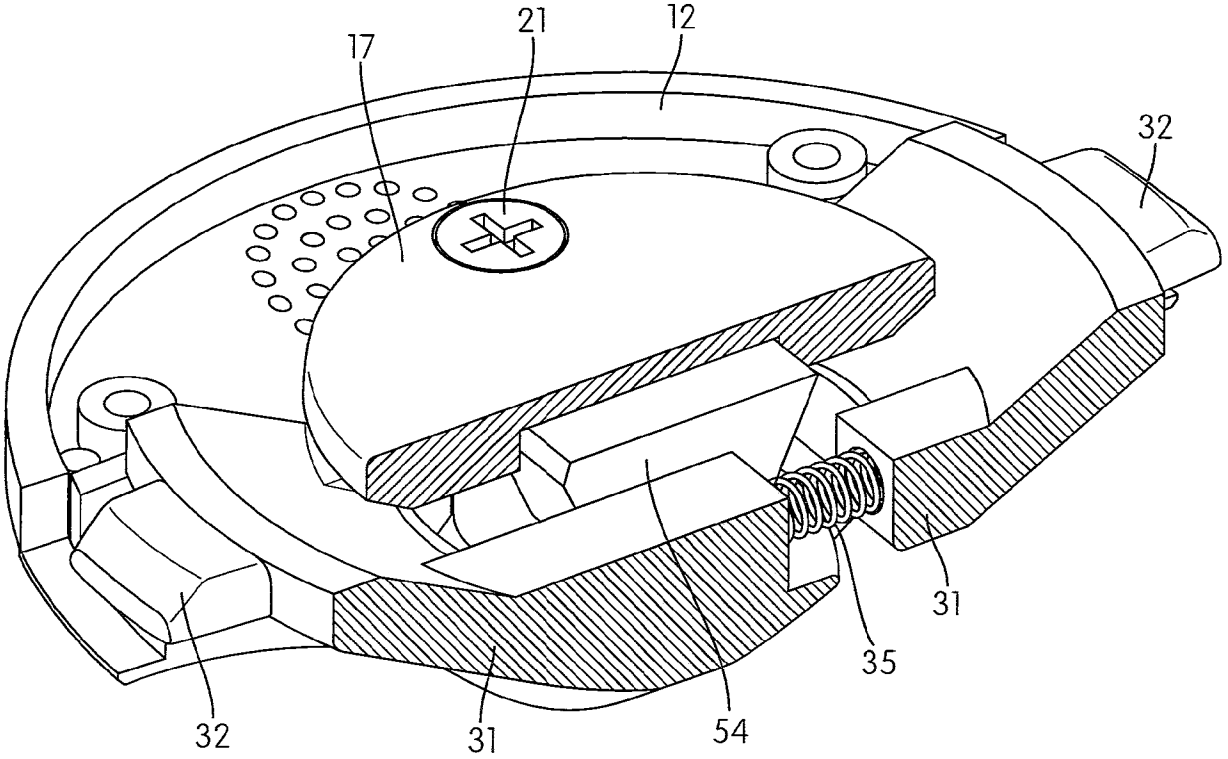
FIG. 6 illustrates an underside, partial cross sectional view of some parts of the lid of the security tag of FIG. 1, in perspective, in accordance with an embodiment.

In the illustrated embodiment of FIG. 6, two tabs 32 are provided, and each tab 32 is connected to or formed integrally with a body 31. Each body 31 may be movable relative to one another. For example, the bodies 31 are designed for elastic movement towards and away from each other via a spring 35 or springs placed therebetween. The spring 35 allows movement of the bodies 51 towards each other such that the tabs 32 can be pulled relative to one another (moved together at the same time or each having an isolated motion, while still being able to move towards the other) or withdrawn in relative to or towards an underside of the top portion 12 or lid. This allows for one or both of the tabs 32 to be withdrawn so that the top portion 12 or lid can be placed on or within the walls of the body 14 when they are aligned. The spring 35 will force the tab or tabs 32 outwardly away from each other and into the aligned receiver(s) 33 of the body 14.

FIG. 7 illustrates an example of connecting the body 14 and the bottom portion 16. The bottom portion 16 includes a lower wall 37 and an upstanding wall 38. As previously noted, the inner wall 23 of the body 14 may be spaced relative to the outer wall 18. As seen in FIG. 7, a slot may be provided between the outer wall 18 and the inner wall 23. This slot may be provided and sized to receive the upstanding wall 38 of the bottom portion 16 therein. As further explained below, the upstanding wall 38 is configured for receipt in the slot of the body 14, and may be moved therein.

Specifically, the housing 11 may be formed of a first portion and a second portion configured for relative movement. In an embodiment, the first portion is configured for movement relative to the second portion in a first direction. The first direction may be a direction that is perpendicular to a plane provided along a wall of a package 100, for example. In an embodiment, the first portion of the housing 11 includes the top portion 12 and body 14, and the second portion includes the bottom portion 16. That is, the top portion 12 and body 14 may be configured to move relative to the bottom portion 16. In an embodiment, the first portion is configured to move in a vertical direction relative to the second portion to activate or deactivate the security tag 10. As shown by the arrow in FIG. 7 and further described below, the top portion 12 of housing 11 may be configured to move downwardly relative to the bottom portion 16, e.g., to activate the alarm therein (and thus the first portion may move upwardly to deactivate the alarm of the security tag 10).

The attachment of the first portion and second portion to each other is not limited. In an embodiment, the portions of the housing 11 are of a click and fit configuration (e.g., top or first portion is clicked onto the bottom or second portion, while still providing limited relative movement).

As shown in FIG. 7 and FIG. 8, respectively, the security tag may be provided in a first position and in a second position. The first position may be an inactive position wherein a sensing system of the security tag 10 is not armed. The second position may be an active position wherein the sensing system is armed and configured for detection to provide an alert.

In an embodiment, in the first position, as shown in FIG. 7, the body 14 may be spaced a distance S1 above the lower wall 37 of the bottom portion 16. The distance S1 provides the maximum space for relative movement of the two portions.

As previously noted, the security tag 10 includes a sensing system therein. The sensing system comprises alarm components 40, or an "alarm," that are received within the internal cavity of the body 14, as shown in FIG. 3. The alarm components 40 of the sensing system can be placed against an inside surface 36 (e.g., see FIG. 4 and FIG. 7) of the bottom wall 34, and are described in greater detail later.

The top portion 12 may include a bulbous portion 15 (see FIG. 4) that extends above its top surface. The bulbous portion 15 may act as an activation part/button that allows a user (e.g., retailer or packager) to push the top portion 12 and body 14 for movement relative to the bottom portion 16. Additionally, the bulbous portion 15 may be provided to house components underneath the top portion 12 or lid. For example, as shown in FIG. 7, a spring 56 and extension 58 can be enclosed by a surrounding housing 54. Such parts may be mechanically, magnetically, or electromechanically activated, e.g., for vertical movement, to activate the circuit within the security tag 10. For example, in an embodiment, the movement of the spring 56 and extension 58 can be clicked by pushing on the bulbous portion 15 to move the parts between a first and second position to turn the alarm on or off.

As shown in FIG. 4, beneath the top portion 12 there may be provided a cap 17 or wall segment that has holes or openings 19 therein and is fastened with the top surface of the top portion 12 via attachment devices 21 (e.g., fasteners or screws). The cap 17 can be used to partially enclose or fully enclose parts in the lid or top portion 12 (e.g., spring 56 and extension 58). As see in FIG. 7, for example, the top portion 12 may include receiving openings 25 for receipts of the attachment devices 21 used to connect the cap 17 to the top portion 12 or lid.

The sensing system comprises at least one optical sensor 60. The optical sensor 60 of the security tag 10 is configured to detect an intensity of ambient radiation within a package that it (the tag) is attached to.

The top and bottom portions 12 and 16 secure parts of the sensing system therebetween, e.g., within the body 14. In an embodiment, the optical sensor 60 may be provided on a lower side of the housing 11. In an embodiment, the optical sensor 60 may be provided near the bottom portion 16 of the housing 11. As shown in the embodiments herein, for example, the optical sensor 60 may be positioned to face downwardly from the housing 11, when the bottom portion 16 is placed against a wall of a package, so that the optical sensor 60 faces an interior or interior cavity of the package. In accordance with an embodiment, as shown in FIG. 7, for example, the optical sensor 60 is provided on a lower surface of the bottom wall 34. The optical sensor 60 can be aligned with an aperture or receiving opening 110 in the package 100 to detect light (ambient radiation) within its interior, so as to sense ambient radiation therein, when the security device is in its second (active) position, for example. The optical sensor 60 can also or alternatively be positioned on the security device such that it may be inserted into the package 100 to detect ambient radiation therein (e.g., moved through a wall).

In an embodiment, the optical sensor 60 is provided on an underside of the housing 11 when the security tag 10 is attached to a lid of the product package. The area for and method of mounting the security device and/or the optical sensor 60 should not be limiting.

The "optical sensor," also called an electro-optical sensor, is an electronic detector that converts light, or a change in light, into an electronic signal. The optical sensor 60 is configured to detect and determine an intensity of ambient radiation it receives within the walls of the package, if there is any. For example, ambient light may enter the package (e.g., through an edge, wall, window, or opening of the package) and deflect off of the walls and/or bottom and/or product within the package, and the reflected radiation is received by optical sensor 60. In an embodiment, it is designed to detect ambient radiation within the package from an environment outside the package and/or from a source outside the package. Once inserted into a package and activated (further described below), the optical sensor 60 may be calibrated according to the detection of ambient radiation within the package upon its activation. The intensity of the ambient radiation received by the optical sensor 60 corresponds to an amount of ambient light detected within the package, e.g., from an outside source (if any). The optical sensor 60 is configured to detect changes of intensity of the ambient radiation within the package (e.g., after its initial calibration). In one embodiment, if a change is detected, e.g., a predetermined change in an amount of intensity from its initial calibration, or any alteration of the light level in the package (some light may seep into the package or box through an aperture for the tag, or gaps in the box), it can optionally activate an alarm or indicator of the security tag 10 to provide an alert when that change is above or exceeds a threshold level.

In an embodiment, the changes in intensity detected by the optical sensor 60 may refer to a predetermined difference (e.g., delta) in the amounts of the intensity readings, which exceed a threshold, when changed (e.g., determined by the optical sensor, or, in some cases, a controller). This is to compensate sudden fluctuations in light intensity do not need to trigger an alarm or alter, such as to compensate for shadows or changes in lighting. In an embodiment, the changes in intensity detected by the optical sensor 60 may refer to a threshold related to a level or amount of light. Further, in an embodiment, the predetermined changes can further be associated with a period of time, e.g., the rate at which the intensity readings change. For example, if the time period for detecting a change in intensity is small, e.g., less than two seconds, the sensing system can be designed to compensate for such changes before activating an alert.

The change in intensity can result in a detection by the tag 10 of tampering with the package or the product within the package itself. For example, when any point on the package and/or one of its walls is moved, opened, ripped, and/or broken, the resulting change in the radiation or light is detected by the sensor (e.g., detection of an increase of light therein). Further, removal of a product from the package will change the amount of ambient radiation detected therein. Moreover, the change(s) in intensity can include if or when the security tag 10 itself is pulled or removed from its associated package (e.g., without the use of a dettager, and instead ripped off of a package). The optical sensor 60 and sensing system can detect this also, because moving, opening, tearing, ripping, and/or breaking the package and/or security tag 10, and thus its optical sensor 60, at any point on the package can increase the light level or radiation detected by the sensor, whether when it is facing an adjacent opening/within the package interior or an outside environment. Optionally, the sensing system of the security tag 10 can trigger the alarm or indicator when such detections occur.

The optical sensor 60 may be any type of sensor for detecting intensity of radiation and/or ambient light. Some known examples of this type of sensor may include, but should not be limited to: photodetectors, phototransistors, and/or photoconductors.

Figure 2:
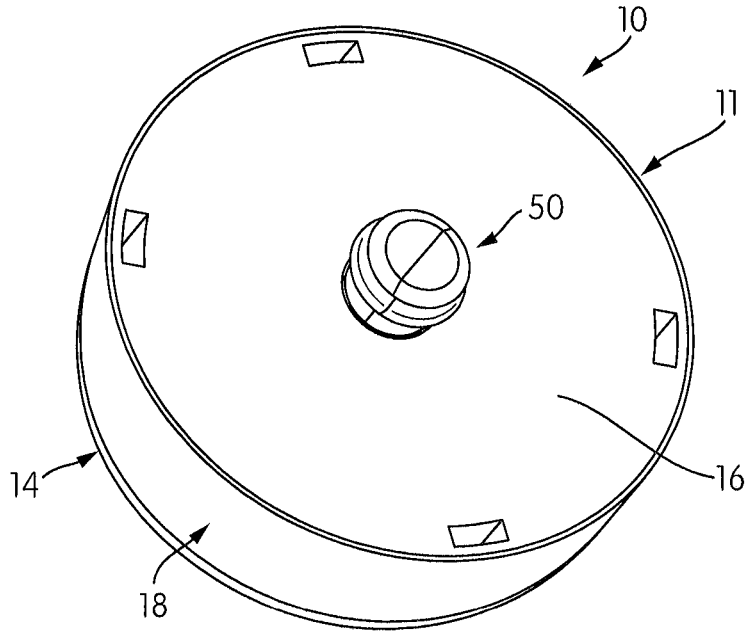
FIG. 2 illustrates a bottom perspective view of the security tag in FIG. 1, in accordance with an embodiment.

In an embodiment, an attachment portion 50 is provided on the security device 10. The attachment portion 50 has a body 51 that is at least partially configured for insertion into a package. The attachment portion 50 may be associated with the second portion of the housing 11. For example, the attachment portion 50 (see FIG. 2 and FIG. 12) may extend outwardly from the bottom portion 16 of the housing 11. The attachment portion 50 may be mounted within or attached to the housing 11, or formed integrally therewith. As shown in FIG. 7, for example, the attachment portion 50 is connected to the bottom portion 16 and extends through an opening 52 through the lower wall 37 in a parallel direction relative to the height of the housing 11 (e.g., both the housing and arm extend in a longitudinal direction). The attachment portion 50 is configured for alignment with and at least partial insertion through an aperture or opening on a package (see FIG. 11). When attachment portion 50 is at least partially inserted into a package, it is configured to lock the security tag 10 in place. In an embodiment, the attachment portion 50 is positioned for insertion into a receiving opening 110 (see FIG. 9) of a package. In an embodiment, the attachment portion 50 can have a pointed end (not shown) to pierce through shrink wrap or other materials around the package as it is entered or forced into the package interior.

The second portion of the housing 11 may further include a lock section 62. The lock section 62 is configured to lock the security tag 10 to an associated package when the security tag 10 is in the second (active) position. The lock section limits the optical sensor 60 of the security tag 10 from detecting ambient radiation within an associated package when the security tag 10 is in the first (inactive) position. The lock section 62 may be activated by an activation device 64 to expose the optical sensor 60 to any ambient radiation or light within the associated package, when the security tag 10 is in the second (active) position. The optical sensor 60 may detect the intensity of the radiation within an interior of the package.

In an embodiment, the attachment portion 50 includes the lock section 62. For example, a portion of, a part of, or the entirety of its body 51 may be formed of one or more moveable sections configured for movement between a first, unlocked position and a second, locked position. Accordingly, when at least a portion of the body 51 of the attachment portion 50 is inserted into the package, it may be moved such that the optical sensor 60 is positioned for detecting ambient radiation from the interior of the package.

In an embodiment, the moveable section 62 includes two arms or halves that are configured to move relative to one another between the first, unlocked position (FIG. 2) and a second, locked position (FIG. 8). The lock section 62 may include a bulbous end portion or limpet. FIGS. 7 and 8 illustrate one half or one side of the moveable section 62. Each arm or half may be configured to open and move or spread outwardly away from the respective other arm or half (like an umbrella) of the moveable section 62 when the lock section 62 is activated and moved to the second, locked position.

Alternatively, in another embodiment, a single arm may be provided as the lock section 62 for movement between the first and second positions. In another embodiment, the lock section 62 may include more than two arms for movement between the first and second positions.

In an embodiment, the device 64 for activating the lock section of the body 51 may be provided on the first portion of the housing 11. For example, the activation device 64 may be in the form of a mechanical device. In an embodiment, the activation device 64 includes a tubular arm that extends downward from the body 14, as shown in FIG. 7. The activation device 64 may extend in a direction parallel to the first direction of movement of the first portion of the housing 11 (i.e., a direction that is relative to the second portion of the housing 11). Further, the activation device 64 may move in the same direction with the first portion or body 14 of the housing 11 towards the second portion or bottom 16 as the security device 10 is moved to its second (active) position from its first (inactive) position, thereby activating the moveable lock section 62 of the body 51 of the attachment portion. In another embodiment, the movement of the activation device 64 may be activated by pressing (e.g., pushing on) the bulbous portion 15.

As shown in FIG. 7, the activation device 64 may be spaced a distance d from the lock section 62. The distance d may be the distance for movement of a bottom of the activation device 64 before or for contact with the moveable section 62 of the body 51 of the attachment portion 50. In an embodiment, the activation device 64 is configured to open, split, separate, or move the lock section 62 by contacting a part of the lock section 62.

In another embodiment, the activation device 64 for activating the lock section 62 may be activated via a magnetic device. In an embodiment, the activation device 64 is magnetically actuated by a magnet. For example, the application of a magnet may cause movement of the activation device 64 such that the moveable lock section 62 of the body 51 of the attachment portion is moved to its second, locked position and the security tag 10 is in its second (active) position.

As shown in FIG. 7, the arms or halves of the lock section 62 may be moved relative to one another (e.g., opened, split, separated) upon application of a magnetic device. In an embodiment, the activation device 64 may be moved the distance d upon application of the magnetic device. Accordingly, the tubular portion of the activation device 64 may simply receive and/or direct light up towards the optical sensor 60 when its open end it uninhibited or unblocked by the lock section 62.

As shown in FIG. 8, the activation device 64 or tube includes a length L extending from a bottom surface of the lower wall 37 towards its end.

Also, a bottom rim of the body 14 may be spaced a distance S1 from the lower wall 37 of the bottom 16. Additionally, the lower surface of bottom wall 34 of body 14 may be spaced a distance S2 from the top or inner surface 39 of the lower wall 37 of the bottom 16.

As seen in FIG. 8, when the body 14 of the housing 11 is moved from its first (inactive) position (as shown in FIG. 7), the body 14 moves the distance S1 relative to the lower wall 37 of the bottom 16. Additionally, the bottom wall 34 moves the distance S2 towards the top or inner surface 39 of the lower wall 37. In an embodiment, S1 and S2 may be substantially similar. As the body 14 is moved into its second (active) position, as shown in FIG. 8), the arms of moveable lock section 62 are opened and the tubular arm or activation device 64 is moved vertically downward as well into the interior of a package, thus activating the lock section 62 of the body 51 of the attachment portion 50 such that the arms capture or connect with a wall of the package and the optical sensor 60 is unblocked for sensing ambient radiation within the package walls.

In an embodiment, the distance d is less than S1 and/or S2. For example, this allows the bottom of the activation device 64 to contact and further extend through the lock section 62, thereby activating the lock section 62 and optionally the optical sensor 60. Moreover, the length L of the activation device 64 may be determined based on the distance of travel to the lock section 62 (to extend into the package) and/or a length of the attachment portion 50, that allows for activation of the lock section 62 and insertion through a wall of the package for receiving and/or directing light towards the optical sensor 60. Activating the lock section 62 exposes the optical sensor 60, allowing ambient radiation from the associated package to be directed up towards and through the tubular arm of the activation device 64, and towards exposed the optical sensor 60. In an embodiment, the length L of the tubular arm of the activation device 64 may be approximately equal to distance S1 and (plus) distance S2.

Thus, the optical sensor 60 is configured to detect the intensity of ambient radiation within the package after the lock section 62 is activated. The optical sensor 60 may also be configured to be calibrated upon and/or after attachment of the housing 11 to the package, e.g., after activation of the security tag 10 by moving the body 14 to its second position, based on ambient radiation detected within the package. The optical sensor 60 is configured to detect changes of intensity of the ambient radiation within the package to activate the alarm or indicator and provide the alert under certain conditions (e.g., above a threshold level).

In an embodiment, the at least one optical sensor 60 is covered or enclosed via a sensor window or exterior surface. The sensor window may comprise a translucent or transparent member for allowing radiation to pass therethrough while preventing inclusion of dust and/or particles from within the package. The window or surface can be substantially flush or flush with a surface of the housing 11. For example, the window or surface may be provided at an end of the activation device 64 that extends into the package 100.

Additional components of the alarm 40 in the security tag 10, include, but are not limited to, a battery 44 in the housing 11, a circuit board 46, and an alarm or indicator that is adapted to provide an alert. As previously noted, the alert may be emitted through an audio device such as a speaker 42. The battery 44 may be positioned within the body 14 such that it can complete the circuit to connect the circuit board 46 and optical sensor 60. The battery 44 has an electrical battery contact 66 in the form of spring arm (e.g., made of formed spring steel). The battery contact 66 may be disconnected when the housing 11 is in its first (inactive) position, and connected to complete the circuit when the housing 11 is in its second (active) position. A battery contact actuation portion 65 can be provided on the inner surface 39 of the lower wall 37 of the bottom 16. The battery contact actuation portion 65 may be in the form of a protrusion extending upwardly from the lower wall 37. The actuation portion 65 is configured for movement and contact with the spring arm of the battery 44 when the circuit/sensing system is activated (e.g., via movement of the body 14). As the body 14 is pushed (e.g., downwardly), for example, the battery contact 66 is moved towards the actuation portion 65 and into contact with the spring arm of the battery 44 to activate the battery 44 and complete the circuit. The bottom wall 34 of the body 14 may include an opening or hole therein to allow the battery contact actuation portion 65 to protrude through the opening or hole and to contact to the spring arm of the battery contact 66, as seen in FIG. 8.

The circuit board 46 is configured to connect the battery 44 within the housing 11 to the alarm or indicator and the optical sensor 60 such that the optical sensor 60 is activated for detection, and the alarm or indicator is connected to the circuit and adapted to provide an alert. Once the sensing system is activated, the battery 44 supplies power to the circuit and to the alarm also found in the security tag 10. The alarm can be associated with the circuit board 46, or added as a separate device within the housing 11.

The circuit board 46 includes circuit board chips 48. These chips may be used to emit the alarm or alert, e.g., via the speaker 42, as well as process the readings from the optical sensor 60. That is, the circuit board 46 acts as a connection circuit as well as a controller and/or processor (e.g., microcontroller and/or microprocessor) is also provided in the sensing system of the security tag 10, hereinafter referred to jointly as a "controller." The chip(s) 48 may be part of the controller. In an embodiment, the controller/circuit board 46 is configured to control and/or provide instructions based on the determined intensity readings of ambient radiation within the package, as detected by the optical sensor. The controller is configured to control other devices based on the intensity of light that is detected and/or any changes in the detected intensity, e.g., that is above or exceeds a threshold level, to trigger or activate an alarm and emit a sound via speaker 42.

Accordingly, as understood by the further description above, in addition to exposing the optical sensor 60 for detecting the intensity of ambient radiation within the package (via activating the lock section 62), movement of the body 14 from the first position to the second position may further activate the circuit connection between the battery 44, circuit board 46, and the optical sensor 60. Movement of the battery contact 66 via the battery contact actuation portion 65 activates the circuit board 46 and its components and completes the circuit. The components, chips 48, or controller associated with the circuit board 46 are configured to activate the optical sensor 60 to detect the intensity of ambient radiation.

The associated alarm or indicator is adapted to provide an alert (e.g., via speaker 42) when a change in intensity is detected or determined using optical sensor 60 that is above or exceeds a threshold level. Put another way, for example, when the sensing system (optical sensor 60 and circuit board 46) detects if a wall has been broken, or a lid opened, or some other event that results in a predetermined amount of change in ambient radiation or light levels, such as by a thief tampering with the product package 100 or other unauthorized entry, an alarm or indicator is triggered. In accordance with an embodiment, when the controller/circuit board 46 detects a predetermined change in intensity (e.g., a substantial increase in the amount of light or ambient radiation that exceeds a threshold), a radio signal can be sent to indicate the detected change, and/or an audible tone or similar sound may be optionally emitted by the alarm via speaker 42. Unauthorized removal of the security tag 10 from the product container assembly also activates the associated alarm or indicator.

The type of alarm, indicator, or alert that is activated by the controller or circuit board 46 is not intended to be limiting. A sound, light, or other visual or hearing aid or notification need not be emitted by and from the security tag 10 itself upon detection of possible unauthorized entry. However, other auxiliary alarms may also be activated based on the detection or readings by elements within the security tag 10. That is, although an alert or determination of tampering may be locally determined and locally activated via the controller, the alarm or indicator can be either locally emitted or remotely emitted, or both. As an example, the security tag 10 may include a communication device or module (e.g., for wireless communication with another device) that is configured to activate an auxiliary alarm in a store or a retail environment (or an environment that is outside of the security tag). The communication device or module may be one or a part of one of the noted circuit board chips 48, for example, or be a separate device that is provided within the housing 11.

The communication device may be configured to communicate wirelessly with an auxiliary alarm or alert outside of the security tag. The tag may include the ability to send and receive wireless signals to a hub, e.g., provided in the store, so that when the alarm is activated, this can route to alert the store management or guards to a theft in process, and/or link up to CCTV or other auxiliary measures or alarms (e.g., within the store itself), to reduce or prevent thefts. The communication device may include a wireless interface which may comprise transceiver, transponder, modulation/demodulation, and memory circuitry, and configured to wirelessly communicate and transmit/receive information upon establishing a network communication link. The wireless protocol used by the security tag 10 for communication with one or more other devices or systems is not intended to be limiting. In an embodiment, the security tag 10 may be equipped with short-range radio technologies (e.g., RFID, NFC, BLE, Bluetooth, ZigBee), mid-range radio technologies (e.g., Wi-Fi), or long-range radio and/or other technologies (e.g., GSM, UMTS, etc.), and may communicate with smartphones or applications associated with such smartphones.

In an embodiment, the emitted sound can be a locally emitted sound, e.g., through an audio device such as a speaker 42 (e.g., with its sound emitted through speaker holes 24, shown in FIG. 1). Additionally and/or alternatively, it is contemplated that the alarm 40 may also detect an electric signal broadcast by the retail location (e.g., remote activation), such as a radio signal or WiFi protocols. The alarm 40 may emit an audible tone or sound (e.g., through its speaker 42 via speaker holes 24) if the electric signal broadcast by the retail location sends instructions to do so. In an embodiment, the emitted sound can be remotely activated and emitted. In one embodiment, the audible sound is emitted at or above approximately 85 db. In another embodiment, the audible sound is emitted at or above approximately 90 db.

For example, a whistle option can be provided in the form of a signal (e.g., radio signal) that can be sent wirelessly to another device, e.g., system, computer, phone, tablet, etc., to alert an authorized person, e.g., supervisor, manager, owner, guard, etc. of the detection, via a wireless communication device. For example, when a security tag detects tampering, a wireless signal can be sent and received by a remote computer system that in turn sends an alert to another remote device of a user or person, e.g., send a text message to a personal phone, pager, or tablet of a security guard in a store containing the product package.

In an embodiment, in addition and/or alternative to the audible alarm, an indicator may be activated. For example, a light or LED provided on the housing 11 may be activated. In another embodiment, an indicator may be remotely activated (e.g., on a screen, on a mobile device, etc.).

In one embodiment, an accelerometer 47 (shown in FIG. 4) may be provided in the security tag 10. The accelerometer 47 may be provided within the housing 11 or body 14, and associated with the circuit board 46. The accelerometer 47 may be used to determine if and/or a rate at which a package that the security tag 10 is attached to is being picked up and handled. The accelerometer 47 acts as a movement sensor to greatly increase the checking rate of the optical sensors. The accelerometer 47 can also help converse battery power and provide a longer lasting tag in operation. This is because circuit designs, once activated, can be activated often to check light levels, and, the higher the refresh rate, the more power is used and drawn from the battery. This shortens battery life. Accordingly, long refresh rates can reduce monitoring and alarm deterrence effectiveness. By adding an accelerometer to the circuit, the length of the refresh/checking rate increases greatly (i.e., by lowering the length of time required to read and refresh, and thus lowering an amount of power drawn from the battery by the activated circuit of the alarm) when the package with the security tag 10 is being handled.

The location of the accelerator 47 as shown in FIG. 4 (e.g., on the circuit board 46) is exemplary only, and not intended to be limiting. For example, the accelerometer 47 may be provided within or on the top 12 or lid or within or on a portion of the body 14 (e.g., inside the internal cavity). The accelerometer 47 may be configured to communicate with the circuit in any number of ways and thus is not limited to the exemplary illustrated embodiment.

Optionally, the sensing system of the security tag 10 can trigger the alarm or indicator when the accelerometer 47 detects movement and the circuit board 46 and/or controller determines that the tag 10 has be removed or ripped off of a package, for example.

Accordingly, it should be understood that a "security tag" or a "security device" as used throughout this disclosure refers to at least a device associated with an optical sensor and an alarm or indicator and configured to activate an alarm or indicator when the optical sensor detects a change in the amount of detected ambient radiation within a package that is above a threshold.

Accordingly, the security tag as disclosed herein guards against product removal from within the package, tag removal from the package, and the packaging walls, lids, etc. itself being physically interfered with.

The security tag 10 cannot be removed by accident since the attachment portion 50 is secured and holds it in place. Therefore, unauthorized removal of the security tag from the product package activates the alarm or indicator, e.g., if the device or the wall(s) are torn. The predetermined opening or hole or aperture in the product package can also help in the positioning of the security device itself onto the package.

The attachment device 50 is also inaccessible from the exterior of the product package 100 making it difficult, if not impossible, for a potential thief to open the package, or to remove a product from the package, without damaging the package walls or lid and/or the security tag 10 itself.

In addition to locking (or unlocking) the security tag 10 in place on a package, movement (e.g., pushing) of the body 14 and its activation device 64 acts in effect as an ON or OFF switch for the security tag 10. For example, as previously noted, downward vertical movement of the body can cause one or more spring electronic contacts 66 (e.g., a spring arm) to connect with battery 44, thus turning the alarm ON. This also adds an advantage in that it allows for conservation of power relative to the security tag in that, when the security tag 10 is not in use, it is turned off, e.g., by clicking or moving the portions of the housing 11 away from each other (activating movement of the first portion vertically upward from the second portion), thus deactivating any use of power from the battery and resulting in a longer lasting life of the security tag.

Figure 12:
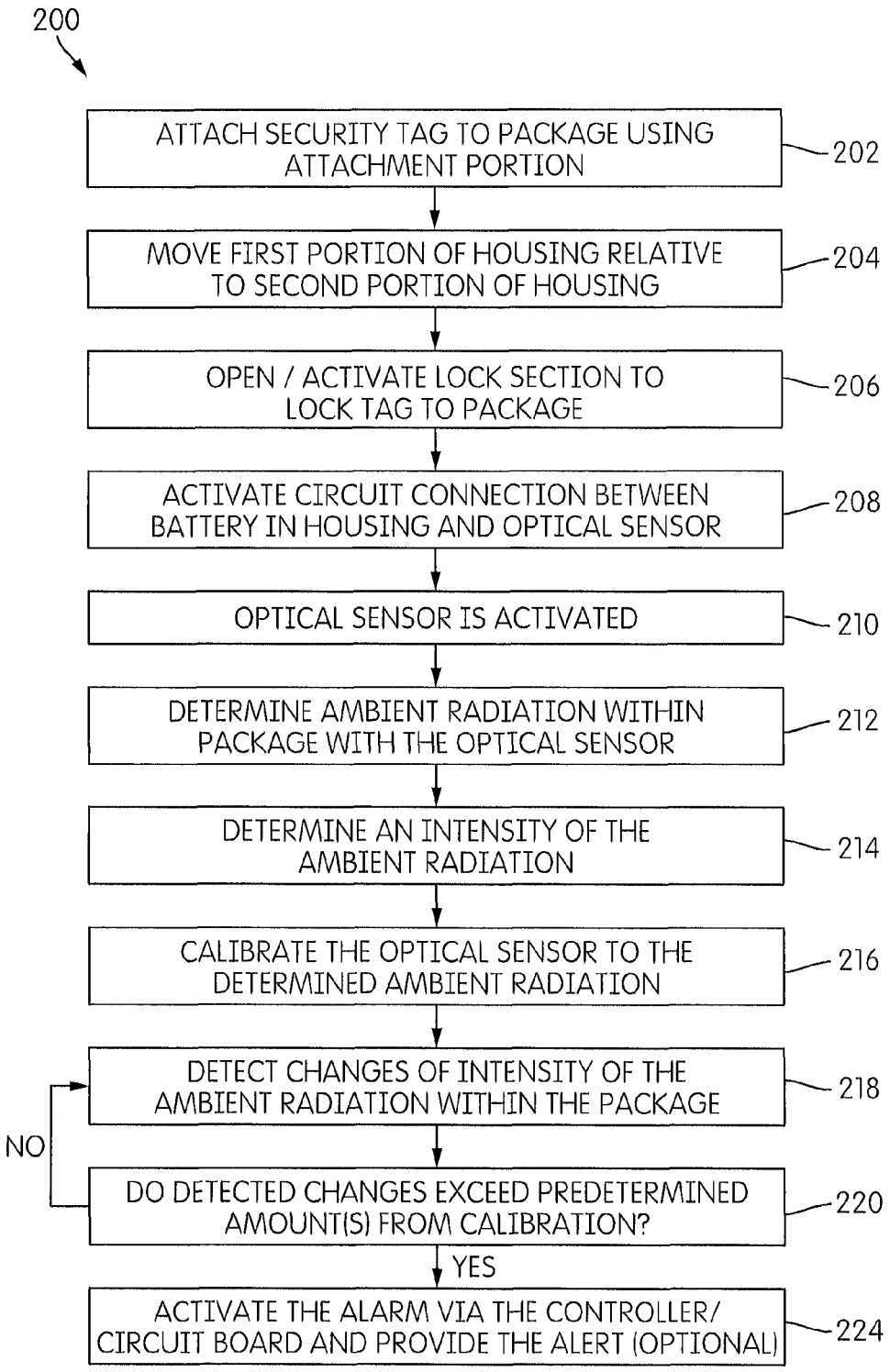
FIG. 12 illustrates a flow chart of a method for operating a security tag attached to a package in accordance with an embodiment.

Thus, a method for operating the security tag 10, as illustrated in FIG. 12, may include one or more of the followings steps: attach the security tag to the package as shown at 202, e.g., via optionally aligning and inserting the attachment portion 50 of the security tag 10 with and through the package (e.g., through an opening, predetermined like receiving opening 110, or not). The first portion of the housing 11, e.g., top portion 12 and body 14, is then moved at 204 relative to the second portion of the housing 11, e.g., bottom portion 16, which results in the device 64 activating or locking the lock section 62 of the attachment portion 50 at 206, to lock the security tag 10 to the package (by moving the lock section from its first position to its second position). Accordingly, the movement activates the optical sensor 60 at 210 by connecting the battery 44 and the optical sensor 60 via the circuit 60, as shown at 208 in FIG. 12, and allowing ambient radiation or light to reach the optical sensor 60 in the housing 11. The optical sensor 60 can determine, read, and/or sense the ambient radiation within the package at 212 (e.g., as received via the body 51 of the attachment portion 50). An intensity of the ambient radiation is also determined by the optical sensor 60 at 214. The optical sensor 60 is then optionally calibrated to the determined ambient radiation within the package at 216. The optical sensor is configured to detect changes of intensity of the ambient radiation within the package at 218 to determine and optionally activate the alarm or indicator and provide the alert. If the detected changes at 220 are not altered or do not exceed a threshold level (e.g., a predetermined amount(s) of change in intensity from a calibration amount), i.e., NO, then, the detection of the changes of intensity of the ambient radiation within the package continues at 218. If, at 220, the detected changes are determined to be above the threshold level (e.g., the intensity is changed or altered by or exceeds a predetermined amount(s) of intensity from a calibration amount), i.e., YES, then the alarm can be activated (e.g., via the controller or circuit board 46) and provide the alert at 224. For example, upon detection of an increase in the intensity of the ambient radiation using the optical sensor 60, the alarm may be activated. In an embodiment, the method 200 further includes determining predetermined changes in intensity of the ambient radiation over a period of time using the circuit.

In an embodiment wherein an accelerometer 47 is provided within the housing 11, the accelerometer can be used to detect movement of the housing. Thus, the method may also include communicating wirelessly with an auxiliary alarm or alert outside of the security tag via the previously noted communication device, e.g., to activate an auxiliary alarm or alert (e.g., within the store), once an amount of movement is detected.

As an alternative to step 220, the method 200 may instead determine include any alteration of the light level in the package to activate the alert or alarm. That is, in an embodiment, any change in an amount of intensity as detected by the optical sensor 60 from its initial calibration may results in the security tag 10 providing an alert at 224.

To deactivate the security tag and remove it from the package, the first portion of the housing 11 can be moved relative to the second portion of the housing 11, which results in the device 64 moving out of the package and the lock section 62 moving from its second position to its first position (e.g., its arms or halves can be moved to a closed position). Accordingly, the movement deactivates the optical sensor 60 by disconnecting the battery 44 and the optical sensor 60 via the circuit 60, and restricts or limits ambient radiation or light from reaching the optical sensor 60 in the housing 11 (since arms of the lock section 62 are closed to cover the opening in the tubular portion of the device 64). The attachment portion 50 of the security tag 10 can then be withdrawn from the package (e.g., through and away from an opening, predetermined like receiving opening 110, or not).

The housing 11 of the security tag 10 as shown in the Figures is not intended to be limiting. For example, in an embodiment, the top portion 12 or lid is integrally formed with the body 14. In another embodiment, the body 14 is integrally formed with the bottom portion 16. Furthermore, the substantially circular shape of the security tag 10 in the Figures is also not intended to limit the disclosed design. Rather, it should be understood that housing 11 and its components may be formed in other shapes, including, but not limited to: ovular, rectangular, square, and/or other polygonal designs. Thus, it should further be understood that any reference to a circumference, diameter, or radius with regards to the exemplary circular shape may also refer to other such corresponding dimensions and descriptors, such as a perimeter, length, width, etc., of the security tag 10. Further, the portions 12 and 16 need not move relative to one another. That is, the bulbous portion 15 and/or a magnetic device may be used to move parts inside the security tag 10 (e.g., the activation device 64 and/or lock section 62) without moving exterior or outer parts of the housing 11.

Accordingly, despite the configuration of the security tag, in either of the examples and methods as noted above, its connection to the package can stop a package from being opened or its product from being taken by operation of an alarm from the connected security tag, because breaking any point of the package can increase the light or radiation therein and triggers the alarm. Further, movement of or removal of the security tag relative to its associated package, or removal of product contents within the package, may also result in a change in intensity that triggers an alarm or indicator.

The security device 10 can be used with any number of types of packages. For example, in an instance where a package is formed from transparent or translucent materials, and/or includes an (optional) opening or window (example described below), the optical sensor 60 may be designed to first calibrate itself according to detected ambient radiation within (or around) the package, received through the opening or window or walls. The sensing system then detects any [reflected] ambient radiation with the optical sensor 60, and determines its intensity.

Also, in embodiments, a security device 10 may further carry a transponder associated with an electronic article surveillance system (EAS) as used in retail environments (e.g. AM, RF, EM, or RFID). This will reduce or prevent unauthorized removal or stealing of packages from a store, because the security device 10 would detect unauthorized movement relative to retailers' security gates at the store exit and/or entrance, and be further configured to activate an alert or alarm (in the device 10 itself or associated with the store) when removal of the product or package is not authorized.

In embodiments, the sensing system of the security device may use any sort of circuitry, software, logic, or a combination thereof to determine the intensity readings of the ambient radiation within the package. For example, in an embodiment, the circuit board 46 and/or its associated controller comprises logic which determines any change in the detected level of intensity of the ambient light or radiation over a period of time. Thus, if a decrease or an increase in intensity of the ambient radiation is determined, a decrease or increase in the amount of ambient radiation in the package is detected. For example, when using photodetectors as optical sensors 60 to receive ambient radiation, a change in intensity is directly proportional to the amount of light within the package. Specifically, an increase in the intensity of the reflected radiation corresponds to an increase in the amount of ambient light within the interior or interior cavity of the package.

The circuit used with the sensing system is not intended to be limiting. In an embodiment, in order to ensure that sudden fluctuations in light intensity do not trigger the alarm 40, the circuitry can be designed with a stabilizer. In addition or alternatively, the controller may use logic and calculations to compensate for shadows, changes in lighting, or other known events that may occur that may affect the amount of ambient light received within the package and that is reflected and/or detected by the at least one optical sensor 60.

The security tag 10 offers numerous anti-theft features for a package. The security tag 10 may trigger an alarm if the optical sensor 60 within the product container has detected a predetermined amount of change in the detected intensity therein, indicating that a portion of the package is broken and/or that an attempt has been made to open the product container.

In an embodiment, the security tag 10 is reusable. It can be removed by a store clerk or user within the store by use of a deactivation device to deactivate the tag.

In an embodiment, once activated, the security tag 10 is armed and cannot be turned off or deactivated. For example, EAS may be used in non-deactivatable versions of tags 10, so that security tags 10 cannot be deactivated by accident, and thus there is no need to deactivate as they do not leave the store but are reused by the store and recycled. The store must remove the tag, and in doing so they will deactivate the alarm that is built in and the light/optical sensor function.

The security tag 10 is also capable of being used in product containers of different sizes. For instance, it is contemplated that in an embodiment the security tag 10 may initially be utilized with a product container for a small electronic device, such as an MP3 player, and then later placed into a product container for a larger electronic device, such as a navigation system.

The size of the security tag 10 may vary based upon the size of the packaging and the type of product being secured.

The method for forming the security tag 10 and its parts is not limited. For example, parts of the housing 11 (e.g., top portion 12 or lid, body 14, and bottom portion 16) may be molded from plastic.

Also, features of the security tag 10 can vary as well. For example, an attachment device 50 does not need to be provided on the tag 10 for securement of the tag 10 to a package or container. In an embodiment, the security tag 10 is configured for attachment using another device, including, but not limited to, stickers, glue or adhesive, magnets, or other attachment methods, that may be in addition to or alternative to the attachment device 50 as disclosed herein. As described above, the security tag 10 can include a housing 11 with the optical sensor 60, battery 44, controller and/or circuit board 46, and speaker 42 (optional) and/or indicator (e.g., light, not shown, and optional) that are connected and in communication with each other when the security tag 10 is activated. The housing 11 may still include a lock section that limits the optical sensor from detection, as well as a movable device for activating the lock section. For example, the optical sensor 60 may be provided on a bottom or a side of the housing 11, and covered in some fashion by the lock section. The movable device may be configured to move or activate the lock section such that the optical sensor 60 is exposed and may be calibrated accordingly.

In one embodiment, the optical sensor 60 can be aligned on a wall (e.g., wall 104 or lid 102) of a package 100 based on a location of a hole 110 therein, such that optical sensor 60 is positioned to calibrate and read ambient light levels inside the package 100, as previously noted. FIG. 9 shows an exemplary product package 100 in the form of a box (e.g., made of paperboard) that can be configured to receive a security device or tag 10 as disclosed herein. Product package 100 has a base or body portion formed with a plurality of side walls 104 and a bottom (not shown), the side walls 104 generally extending upwardly or vertically from the bottom, and a lid portion 102 connected, e.g., by a (living) hinge portion to at least one side wall.

As understood by one of skill in the art, a blank that can be used to form the box 100. The blank may be formed with a plurality of sidewalls that are assembled and folded and/or bent along optional fold lines and secured via flaps and/or tabs, to form a package or enclosure with an opening for placing contents into its interior cavity, for example.

The lid 102 as shown in FIGS. 9 and 10 moves between open and closed positions relative to one or more of the side walls 104. In an embodiment, it includes a receiving opening 110 therein, shown in FIG. 9. The receiving opening 110 may be designed for receipt of the attachment portion 50 of the security device 10, so that the security device 10 can be attached and secured to the package 100, as shown in FIG. 10. The size of the receiving opening 110 may be varied. In one embodiment, the size of the receiving opening 110 is based on the size of the attachment portion 50. In an embodiment, the receiving opening 110 has a diameter of approximately 5.0 mm. In accordance with an embodiment, the housing 11 of the security device 10 is provided adjacent to and/or on top of the lid 102 such that the optical sensor 60 can detect intensity within the interior of the package 100 after it is activated. The product package 100 can be formed to accommodate its attachment.

In an embodiment, the security device 10 may be removably attached to a receiving opening on an outside of a product container or package.

Figure 11:
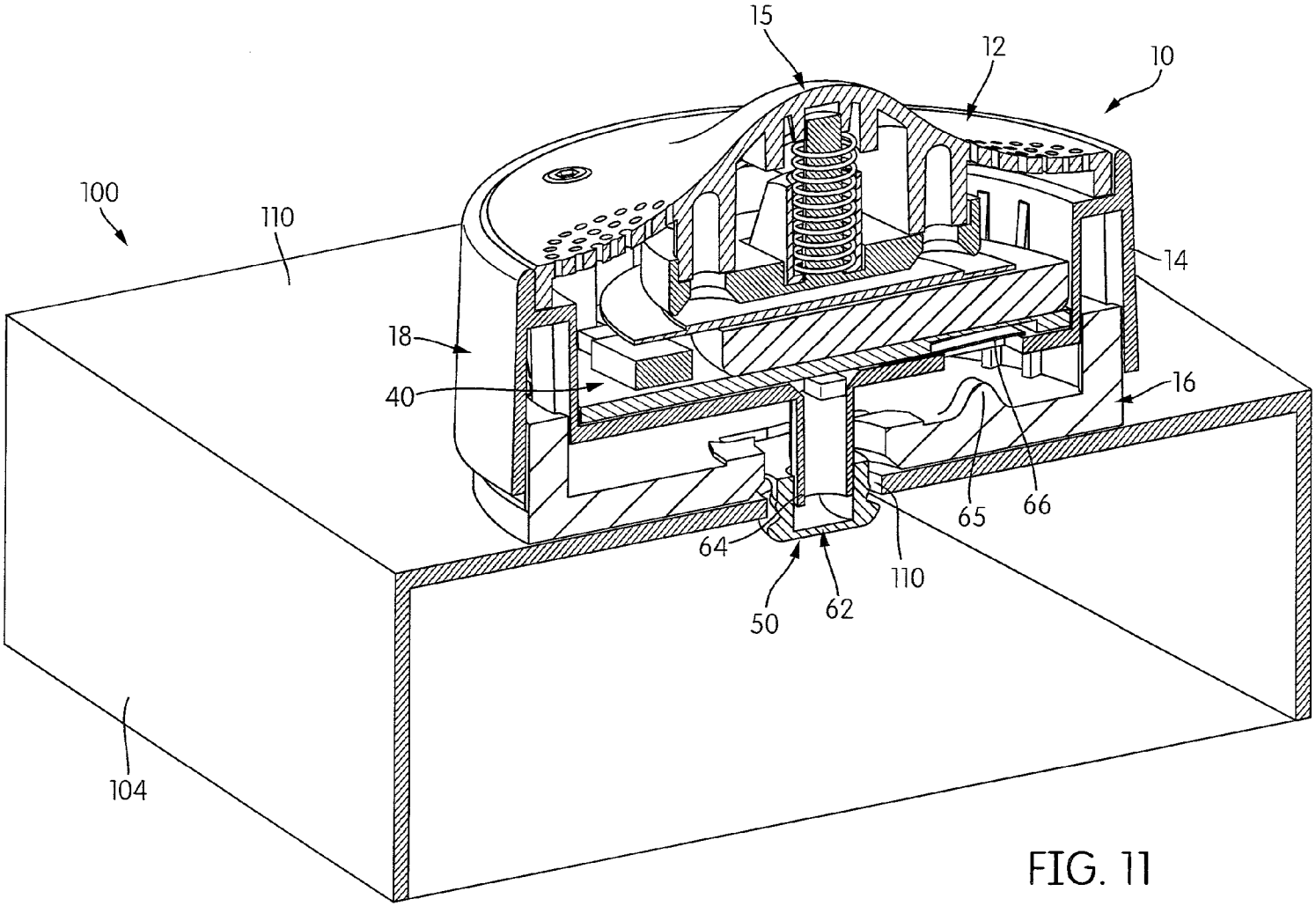
FIG. 11 illustrates a cross sectional view of the security tag attached to the product container of FIG. 9 and in a first position, in accordance with an embodiment.

As shown in FIG. 11, the security device 10 is adapted to cooperate with the product package 100 in its assembled form via alignment with and subsequent insertion of its attachment portion 50 through the receiving opening 110. Accordingly, after insertion of the attachment portion 50 of the security device 10 through receiving opening 110, the first portion of the housing 11, e.g., the top portion 12 or lid and the body 14, can be moved or pushed (e.g., via bulbous portion 15) from its first (inactive) position downwardly relative to the bottom portion 16, and into its second (active) position. The security tag 10 is securely attached to the package 100 and the alarm 40 of the security tag 10 may then be activated. FIG. 11 illustrates, in cross-section, an example of the security tag 10 as attached to the package 100 in the first position. Pressing of the body 14 (e.g., downwardly) so that its activation device 64 activates (e.g., opens, splits, moves) the lock section 62 and moves it tubular body through the receiving opening 110 ensures attachment of the security tag 10 to the package 100 and insertion of the tubular body into the package so that radiation / light is directed towards the optical sensor. Further, as previously described, it electrically connects the circuit by moving the battery contact actuation portion 65 into contact with the battery contact 66 of the battery 44 (see FIG. 8) to activate the components of the alarm 40, including reading/sensing by the optical sensor 60. As shown in FIG. 11, then, the optical sensor is positioned to face downwardly into the interior cavity of the package 100, the interior cavity being provided below the optical sensor 60.

The security device cannot be removed by accident since the lock section 62 of the attachment portion 50 holds it in place. Therefore, unauthorized removal of the security device from the product package can activate the alarm or indicator. The receiving opening 110 also helps the positioning of the security tag 10 itself. The location of the receiving opening can be based on the location of the attachment portion 50 of the security device to be attached, for example.

It is noted that the location and the exemplary illustration of the openings and the positioning of the security device on the top wall, as shown, is not intended to be limiting.

In an embodiment, openings for insertion of the attachment device 50 may not need to be provided. The security device can additionally and/or alternatively be adapted to cooperate with the product package via insertion through other aligned openings.

Optionally, in one embodiment, the product package may further include a number of score lines placed on the interior of any one of its walls, tabs, flaps, or lid. Score lines do not necessarily need to extend all of the way through the substrate (from the interior to the exterior). Score lines can provide a built in weakness in the walls and assist in tearing of the same. That is, they can increase the probability that the printed circuit will be broken if the walls are torn or moved. Accordingly, when one or more score lines on one of the walls or tabs is severed, ambient radiation or light from outside can enter into the product package 100. Thus, the optical sensor 60 can detect the change of intensity of ambient radiation within the interior cavity, and a determination can be made if an alarm should be activated (or not).

The addition of score lines in addition to adhesive in seam areas of the package (e.g., bottom, side) encourages tearing if the walls are tampered with by enhancing a weakness in the area and helps ensure tearing of a wall or tab. The scoring lines may be in the form of lines, dashes, dots, notches, etc.

and are not limited to the illustrated design. In an embodiment, the score lines comprise perforations.

Although not shown, the product package 100 can further include a hanging tab with an opening for hanging on a display. In an embodiment, the opening for hanging can be formed in a wall, e.g., in a side wall 104.

In an embodiment, exterior surfaces of one or more of the walls may include stickers, labels, or other product markings thereon. In an embodiment, a display opening is provided that can be used to allow scanning or reading of a bar code, for example.

In an embodiment, at least one window may be provided in one or more walls of the package 100. In an embodiment, the window may be formed from material that is substantially translucent or transparent or, alternatively, comprise a through opening. The at least one window permits ambient light constituting ambient radiation to enter the package 100. The window (or opening) may also allow a user to view the contents within the package 100. The window permits light to be directed into the interior cavity of the package 100. Ambient light can enter from a plurality of directions and be reflected off of any product or contents in the interior as well as the interior of the walls 104. The sensor system of the security device 10 can be calibrated based on the ambient radiation that enters the package via the window, e.g., when positioned or hanging on a display rod or shelf.

In another embodiment, one or more of the walls and/or lid are formed from substantially translucent or transparent material. In a similar manner, the security system can be calibrated based on the light therein.

The manufacture of product containers or packages shown herein is not meant to be limiting. A lid and a walls of the package made be formed using any number of techniques. Packages made from a paper based material, such as paperboard, cardboard, and the like, to form a box or similar shape, or two sided container, can be manufactured as a generally flat sheet, or "blank," that can be designed to be folded together, and can optionally utilize flaps, tabs, adhesives, and/or adhesives in order to make the generally flat sheet into a product container. However, it should be noted that the product package 100 may be made from a variety of materials including polymeric materials, paper, paperboard, cardboard, plastics, thermoplastics, and the like. The security tag 10 allows materials such as paper, paperboard, and cardboard, etc. to be utilized—alone or in combination—even with more expensive products or contents therein, as the alarm 40 of the security tag 10 will activate if the product package 100 is tampered with in an effort to remove its content, reducing the likelihood of a thief stealing the contents of the product container 100.

The security tag 10 may optionally assist in keeping the product container locked in a closed orientation. The security tag 10 may secure the product container 10 in a closed arrangement. In an embodiment, an attached or secured security tag 10 can substantially prevent access to contents within a product package or container by assisting in securing one wall (e.g., lid) to another wall (e.g., side wall).

The illustrated embodiments described herein are not meant to be limiting. Accordingly, it is in accordance with an embodiment herein to provide a security tag. The security tag may be used in or with a package. The security tag includes: a housing with a battery therein; an optical sensor configured to detect ambient radiation within the package and a circuit configured to connect the battery and the optical sensor. An alarm or indicator is further connected to the circuit and adapted to provide an alert. Also included is an attachment portion for attaching the housing to the package that has a lock section that limits the optical sensor from detecting the ambient radiation within the package. A device for activating the lock section is provided. The optical sensor is configured to detect changes of intensity of the ambient radiation within the package. The optical sensor is also configured to activate the alarm or indicator and provide the alert upon detection of a change in intensity above a threshold level.

In an embodiment, this disclosure provides a security tag that includes: a housing with a battery therein and an optical sensor within the housing. The housing has a first portion and a second portion, and the first portion is configured for movement relative to the second portion. The optical sensor is configured to detect ambient radiation within the package. The second portion of the housing has a lock section that limits the optical sensor from detecting ambient radiation within the package. The first portion has a device for activating the lock section. The security tag further has a circuit configured to connect the battery and the optical sensor such that the optical sensor is activated for detection and an alarm or indicator further connected to the circuit and adapted to provide an alert. Movement of the first portion relative to the second portion is configured to correspondingly move the device for activating the lock section, thereby activating the lock section to expose the optical sensor for detecting the ambient radiation within the package and further activate the circuit connection between the battery and the optical sensor. The optical sensor is configured to detect changes of intensity of the ambient radiation within the package. The optical sensor is configured to activate the alarm or indicator and provide the alert upon detect of a change in intensity above a threshold level.

It is in accordance with an embodiment to provide a product package with a security tag. The product package includes: a plurality of walls configured to contain contents in an interior cavity; at least one of the plurality of walls of the product package configured to be moved between (a) an open position allowing access to contents inside the interior cavity of the product package via an opening and (b) a closed position substantially preventing access to the contents within the interior cavity therein by closing the opening; and a security device being removably connected to the product package. The security device includes a housing with a battery, an optical sensor positioned and configured to detect ambient radiation in the interior cavity of the product package, a circuit configured to connect the battery and the optical sensor for detection, an alarm or indicator connected to the circuit and adapted to provide an alert, an attachment portion for attaching the housing to the package, and a device. The attachment portion has a lock section that limits the optical sensor from detecting ambient radiation within the package. The device is provided for activating the lock section. The optical sensor is configured to detect changes of intensity of the ambient radiation within the package. The optical sensor is also configured to activate the alarm or indicator and provide the alert upon detection of a change in intensity above a threshold level.

In an embodiment herein, there is provided a method for operating a security tag attached to a package. The security tag has a housing, a battery, an optical sensor configured to detect an intensity of ambient radiation within the package, a circuit configured to connect the battery and the optical sensor such that the optical sensor is activated for detection, and an alarm or indicator adapted to provide an alert. The housing includes a first portion and a second portion. The first portion is configured for movement relative to the second portion in a first direction. The second portion has a lock section that limits the optical sensor from detecting the intensity of ambient radiation within the package, and the first portion has a device for activating the lock section. The method includes activating the optical sensor by moving the first portion relative to the second portion in the first direction; detecting changes of intensity of the ambient radiation within the package; and activating the alarm or indicator and providing the alert. Movement of the first portion relative to the second portion activates the device for activating the lock section thereby activating the lock section to expose the optical sensor for detecting the ambient radiation within the package and further activate the circuit connection between the battery and the optical sensor. The optical sensor is configured to activate the alarm or indicator and provide the alert upon detection of a change in intensity above a threshold level.

The features described with respect to each of the embodiments herein are not limited to those designs for which they are shown. For example, tabs, flaps, openings or holes, fold lines, score lines, and the like may be provided on and/or removed from any of the embodiments described herein. The circuit for connecting the battery to the optical sensor for activation thereof can be provided within the housing in any number of ways. Any number of methods or materials can be used to form the housing of the security tag and the parts herein. Similarly, the product package, case, container, structure, or blank used to form the package can be formed from any number of materials and in any number of methods.

Further, the use of the herein disclosed security tag with different sizes, shapes, and assemblies of product packages should be understood by one of ordinary skill in the art. A blank that is configured for assembly can be used with the illustrated embodiments herein. For example, in some embodiments, blanks of the different packages can be partially assembled or adhered together for assembly, but flattened so that they can be packed for shipping (i.e., before objects or contents are placed therein). A security tag as disclosed herein can be used with such packages or blanks Also, in some embodiments, packages can be assembled, a product placed therein, closed, and then secured with shrink wrap or a similar product. The security tag may be attached to a package (e.g., for alignment with an aperture, or through a predetermined receiving opening using the attachment portion) after the package with the product therein is shrink-wrapped. The attachment portion can pierce through the shrink wrap when inserted into the package (e.g., through the receiving opening and into the interior cavity of the package). The device for activating the lock section can move through the receiving opening to activate the lock section, and, optionally also pierce through the shrink wrap.

Furthermore, the formation of the package and/or the security device is not intended to be limited. The package, the security device, and/or each of their parts can be molded or formed.

Moreover, it should be understood that the disclosure herein is not intended to limit use of the herein disclosed security tag to a new type of package or blank that needs to be manufactured. A security tag with features as disclosed herein that can attach to any pre-assembled product package by inserting its attachment portion into the interior is also within the scope of this disclosure. Additionally, openings can be formed in existing packages to accommodate attachment of the security tag to such devices.

The receiving opening 110 on the package 100 for the attachment portion 50 (and alignment of the optical sensor to face into the interior cavity of the package) does not need to be specifically formed within or punched in a wall 104 or a lid 102 of the package 100. The receiving opening 110 could already be formed in the package 100 itself. It can be a portion of the package 100 that provides access into its interior and that can receive the attachment portion, e.g., a space between parts of the package walls 104 or lid 102, or the attachment portion 50 could be inserted at or near a seam or edge.

Moreover, the location for attachment of a security tag to the package is not limited. Also, the placement of security tag onto the package does not necessarily need to be inserted at a point at or near the opening or closure of the package, but rather a point that allows for the positioning of the optical sensor to detect and calibrate in relation to radiation or light in its interior without departing from the scope of this disclosure, so that when any point on the package and/or one of its walls is moved, opened, ripped, and/or broken, the resulting change in the radiation or light is detected by the sensor (e.g., a detection of an increase of light therein). When a predetermined amount or change of light is detected within the package, e.g., above a threshold, thereby resulting in a calculation or determination of unauthorized access or entry, the alarm or indicator associated with the security tag can be triggered.

It should be understood that the design and shape of the security tag as shown herein is not intended to be limiting, and that other shapes and/or designs, for example, may be implemented in a similar manner and still be within the scope of this disclosure. For example, the attachment portion may be designed to extend in a different direction relative to the housing, e.g., in a direction that is perpendicular to the direction of movement of the first portion of the housing relative to the second portion of the housing, in accordance with an embodiment. The optical sensor may be positioned to face a side of the security tag in an embodiment.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A security tag for a package comprising:

a housing with a battery therein;

an optical sensor configured to detect ambient radiation within the package;

a circuit configured to connect the battery and the optical sensor;

an alarm or indicator further connected to the circuit and adapted to provide an alert;

an attachment portion for attaching the housing to the package, the attachment portion comprising a lock section that limits the optical sensor from detecting the ambient radiation within the package; and a device for activating the lock section;

wherein the optical sensor is configured to detect changes of intensity of the ambient radiation within the package, and wherein the optical sensor is configured to activate the alarm or indicator and provide the alert upon detection of a change in intensity above a threshold level.

2. The tag according to claim 1, further comprising a controller configured to control activation of the alarm or indicator based on detections by the optical sensor.

3. The tag according to claim 1, wherein housing comprises a first portion and a second portion, wherein the first portion is configured to move in a vertical direction relative to the second portion, wherein the device for activating the lock section is associated with the first portion, and wherein vertical movement of the first portion relative to the second portion is configured to activate or deactivate the device for activating the lock section via movement of the device in the vertical direction.

4. The tag according to claim 1, wherein the optical sensor is positioned to face downwardly from the housing.

5. The tag according to claim 1, wherein the attachment portion is configured for alignment with and insertion through an aperture or opening on the package.

6. The tag according to claim 1, further comprising an accelerometer within the housing and associated with the circuit.

7. The tag according to claim 1, further comprising a communication device configured to communicate wirelessly with an auxiliary alarm or alert outside of the security tag.

8. A security tag for a package comprising:

a housing with a battery therein, the housing comprising a first portion and a second portion, the first portion configured for movement relative to the second portion in a first direction;

an optical sensor within the housing configured to detect ambient radiation within the package;

the second portion comprising a lock section that limits the optical sensor from detecting ambient radiation within the package;

the first portion comprising a device for activating the lock section;

a circuit configured to connect the battery and the optical sensor such that the optical sensor is activated for detection;

an alarm or indicator further connected to the circuit and adapted to provide an alert; and wherein movement of the first portion relative to the second portion is configured to correspondingly move the device for activating the lock section thereby activating the lock section to expose the optical sensor for detecting the ambient radiation within the package and further activate the circuit connection between the battery and the optical sensor, wherein the optical sensor is configured to detect changes of intensity of the ambient radiation within the package, and wherein the optical sensor is configured to activate the alarm or indicator and provide the alert upon detect of a change in intensity above a threshold level.

9. The tag according to claim 8, wherein the device for activating the lock section extends in a direction parallel to the first direction of movement of the first portion of the housing relative to the second portion of the housing.

10. The tag according to claim 8, wherein the optical sensor is positioned to face downwardly from the housing.

11. The tag according to claim 8, further comprising an attachment portion for attaching the housing to the package.

12. The tag according to claim 11, wherein the attachment portion is part of the second portion of the housing.

13. The tag according to claim 11, wherein the first portion is provided as a top of the housing, wherein the second portion is provided as a bottom of the housing, wherein the attachment portion extends from the bottom part of the housing.

14. The tag according to claim 8, further comprising an accelerometer within the housing and associated with the circuit.

15. The tag according to claim 8, further comprising a communication device configured to communicate wirelessly with an auxiliary alarm or alert outside of the security tag.

16. A product package comprising:

a plurality of walls configured to contain contents in an interior cavity;

at least one of the plurality of walls of the product package configured to be moved between (a) an open position allowing access to contents inside the interior cavity of the product package via an opening and (b) a closed position substantially preventing access to the contents within the interior cavity therein by closing the opening; and a security device being removably connected to the product package, the security device comprising a housing with a battery, an optical sensor positioned and configured to detect ambient radiation in the interior cavity of the product package, a circuit configured to connect the battery and the optical sensor for detection, an alarm or indicator connected to the circuit and adapted to provide an alert, an attachment portion attaching the housing to the package, the attachment portion comprising a lock section that limits the optical sensor from detecting the ambient radiation within the package, and a device for activating the lock section;

wherein the optical sensor is configured to detect changes of intensity of the ambient radiation within the package, and wherein the optical sensor is configured to activate the alarm or indicator and provide the alert upon detection of a change in intensity above a threshold level.

17. The product package according to claim 16, wherein the optical sensor on the housing of the security device is positioned in line with an aperture or opening on the product package.

18. The product package according to claim 16, wherein the attachment portion extends from a bottom of the housing for insertion into the product package.

19. The product package according to claim 18, further comprising a receiving opening within one of the plurality of walls of the product package providing access to the interior cavity, and wherein the attachment portion is inserted through the receiving opening.

20. The product package according to claim 16, further comprising an accelerometer within the housing and associated with the circuit.

21. The product package according to claim 16, further comprising a communication device configured to communicate wirelessly with an auxiliary alarm or alert outside of the security tag.

22. A method for operating a security tag attached to a package, the security tag comprising a housing, a battery, an optical sensor configured to detect ambient radiation within the package, a circuit configured to connect the battery and the optical sensor such that the optical sensor is activated for detection, and an alarm or indicator adapted to provide an alert, wherein the housing comprises a first portion and a second portion, the first portion configured for movement relative to the second portion in a first direction, the second portion comprising a lock section that limits the optical sensor from detecting the intensity of ambient radiation within the package, and the first portion comprising a device for activating the lock section; the method comprising:

activating the optical sensor by moving the first portion relative to the second portion in the first direction;

detecting changes of intensity of the ambient radiation within the package; and activating the alarm or indicator and providing the alert, wherein movement of the first portion relative to the second portion activates the device for activating the lock section thereby activating the lock section to expose the optical sensor for detecting the ambient radiation within the package and further activate the circuit connection between the battery and the optical sensor, and wherein the optical sensor is configured to activate the alarm or indicator and provide the alert upon detection of a change in intensity above a threshold level.

23. The method for operating the security tag according to claim 22, further comprising detecting changes in intensity of the ambient radiation over a period of time using the circuit before determining if the change in intensity is above the threshold level.

24. The method for operating the security tag according to claim 22, wherein the device for activating the lock section extends in a direction parallel to the first direction of movement of the first portion of the housing relative to the second portion of the housing, and wherein the moving the first portion relative to the second portion further comprises moving the device for activating the lock section in the first direction.

25. The method for operating the security tag according to claim 22, further comprising an accelerometer within the housing and associated with the circuit, and wherein the method further comprises detecting movement of the housing via the accelerometer.

26. The method for operating the security tag according to claim 22, further comprising a communication device configured to communicate wirelessly with an auxiliary alarm or alert outside of the security tag, and wherein the method further comprises communicating wirelessly via the communication device with an auxiliary alarm or alert.

* * * * *